US006217486B1

(12) United States Patent
Rosenow

(10) Patent No.: US 6,217,486 B1
(45) Date of Patent: Apr. 17, 2001

(54) ELLIPTICAL STEP EXERCISE APPARATUS

(75) Inventor: Charles J. Rosenow, Carol Stream, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/332,860

(22) Filed: Jun. 15, 1999

(51) Int. Cl.[7] ..... A63B 69/16; A63B 22/12
(52) U.S. Cl. ..... 482/52; 482/57; 482/70
(58) Field of Search ..... 482/51, 52, 57, 482/70, 79, 80, 148, 58, 62, 61, 53

(56) References Cited

U.S. PATENT DOCUMENTS

| | | | | |
|---|---|---|---|---|
| 4,477,072 | * | 10/1984 | DeCloux | 482/57 |
| 4,786,050 | | 11/1988 | Geschwender | 272/73 |
| 5,518,473 | | 5/1996 | Miller | 482/57 |
| 5,549,526 | * | 8/1996 | Rodgers | 482/70 |
| 5,577,985 | | 11/1996 | Miller | 482/52 |
| 5,593,372 | | 1/1997 | Rodgers, Jr. | 482/52 |
| 5,743,834 | | 4/1998 | Rodgers, Jr. | 482/57 |
| 5,762,588 | | 6/1998 | Chen | 482/57 |
| 5,779,599 | | 7/1998 | Chen | 482/57 |
| 5,792,026 | | 8/1998 | Maresh et al. | 482/51 |
| 5,848,954 | | 12/1998 | Stearns et al. | 482/52 |
| 5,857,941 | | 1/1999 | Maresh et al. | 482/52 |
| 5,882,281 | | 3/1999 | Stearns et al. | 482/51 |
| 5,893,820 | | 4/1999 | Maresh et al. | 482/51 |
| 5,957,814 | | 9/1999 | Eschenbach | 482/51 |
| 6,045,487 | * | 4/2000 | Miller | 482/52 |
| 6,063,009 | * | 5/2000 | Stearns et al. | 482/52 |
| 6,083,143 | * | 7/2000 | Maresh | 482/57 |
| 6,099,439 | | 8/2000 | Ryan et al. | 482/51 |

* cited by examiner

*Primary Examiner*—Stephen R. Crow
(74) *Attorney, Agent, or Firm*—Michael B. McMurry; Kathleen A. Ryan

(57) ABSTRACT

An exercise apparatus includes a frame that is adapted for placement on the floor, a pivot axle supported by the frame, a bent pedal lever, a pedal that is secured to the bent pedal lever and a variety of pedal actuation assemblies. These pedal actuation assemblies include components which cooperate to provide an elliptical path and provide the desired foot flexure and weight distribution on the pedal. Consequently, as the pedal moves in its elliptical path, the angular orientation of the pedal, relative to a fixed, horizontal plane, such as the floor, varies in a manner that simulates a natural heel to toe flexure.

5 Claims, 17 Drawing Sheets

ELLIPTICAL STEP EXERCISE APPARATUS

FIELD OF THE INVENTION

This invention relates generally to exercise equipment and more particularly to exercise equipment which can be used to provide a user with an elliptical step exercise.

BACKGROUND OF THE INVENTION

There are a number of different types of exercise apparatuses that exercise a user's lower body by providing a circuitous stepping motion. These elliptical stepping apparatuses provide advantages over other types of exercise apparatuses. For example, the elliptical stepping motion generally reduces shock on the user's knees as can occur when a treadmill is used. In addition, elliptical stepping apparatuses exercise the user's lower body to a greater extent than, for example, cycling-type exercise apparatuses. Examples of elliptical stepping apparatuses include U.S. Pat. Nos. 3,316,898; 5,242,343; 5,383,829; 5,499,956; 5,685,804; 5,759,136; 5,762,588; 5,779,599; 5,792,026; 5,899,833 and German Patent No. DE 2 919 494.

However, known elliptical stepping exercise apparatuses suffer from various drawbacks. For example, some apparatuses are limited to exercising the user's lower body and do not provide exercise for the user's upper body. In addition, the elliptical stepping motion of some apparatuses does not produce an optimum foot motion including heel to toe flexure. Moreover, due to their mechanical arrangement, some previous stepping exercise apparatuses can be difficult for the user to mount. Also, for those exercisers that include arm handles for upper body exercise, the range of motion of the arm handle in many instances does not provide for a comfortable upper body exercise. A need therefore exists for an improved elliptical stepping exercise apparatus. One such improved elliptical stepping exercise apparatus can be found in a commonly owned application entitled "Cross Training Exercise Apparatus", Ser. No. 08/814,487 (hereinafter "the '487 application"). The entire disclosure of the '487 application is incorporated herein by reference.

SUMMARY OF THE INVENTION

It is therefore an object of the invention to provide an elliptical stepping exercise apparatus that exercises the user's lower and upper body in an easy to use and comfortable manner.

Another object of the invention is to provide a stepping exercise apparatus that simulates a natural foot motion thereby promoting exercise efficiency.

Another object of the invention is to provide an elliptical stepping exercise apparatus that has a bent pedal lever thereby making it easier for the user to mount.

Another object of the invention is to provide an elliptical stepping apparatus that provides for upper body exercise utilizing arm handles connected to rockers which in turn are connected to the pedal levers where the arm handles are approximately the same length as the rockers.

In addition, unlike some examples of elliptical stepping apparatuses such as the machine shown in U.S. Pat. No. 5,383,829, the preferred embodiment of the invention does not utilize a coupling member to pivotally couple the pedal levers to the pivot axis. By contrast, the present invention uses a stroke link which is pivotally connected between a crank arm and a lower section of the pedal lever. Additionally, the pedal lever is not pivotally connected to the crank but instead rides on a roller and is bent to provide easier user access to the machine. As a result of the action of the stroke link and the roller, the end of the bent pedal lever travels in an elliptical path. A significantly different and unique foot motion will result due to the elliptical path taken by the end of the pedal lever.

These and other objectives and advantages are provided by the present invention which is directed to an exercise apparatus that can be employed by a user to exercise the user's upper and lower body.

BRIEF DESCRIPTION OF THE DRAWINGS

In the drawings which illustrate the best modes presently contemplated for carrying out the invention.

DETAILED DESCRIPTION

Figure 1:
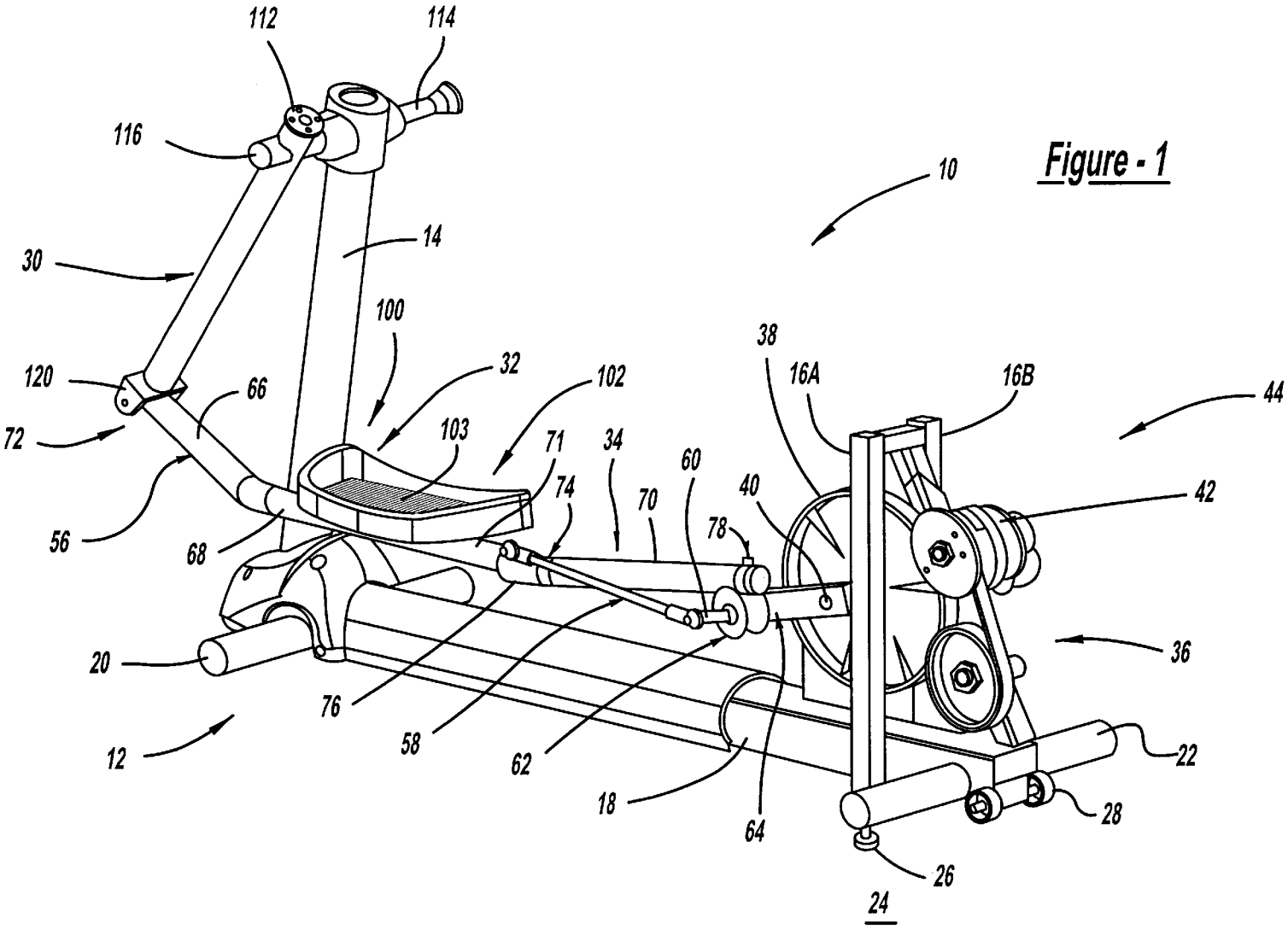
FIG. 1 is a partially cut-away side perspective view of the preferred embodiment of an exercise apparatus according to the invention.

I. Overview of Mechanical Aspects of the Invention

A primary objective of the present invention is to provide a mechanically simple elliptical stepping exercise apparatus in which the pedal follows a substantially elliptical pathway in such a manner so as to simulate the natural foot weight distribution, and optimal foot motion and flexure associated with a natural walking or running gait while at the same time providing a synchronized mechanism for upper body exercise. The present invention implements numerous different pedal actuation assemblies for providing this more natural foot motion. In addition, each of these pedal actuation assemblies can be connected to an arm handle assembly to provide an upper body workout.

This invention is thus directed to numerous general embodiments of an exercise apparatus in which the foot pedal follows a substantially elliptical pathway and moves in a manner that simulates a natural weight distribution, and a natural foot motion and flexure of a foot associated with the normal human walking or running gait. It should be understood, however, that the mechanisms as described can be modified within the scope of the invention to produce other types of foot motion. The first general embodiment, which is the preferred embodiment of the invention, is discussed with reference to FIGS. 1–6. The second general embodiment is discussed with reference to FIG. 7. The third general embodiment is discussed with reference to FIGS. 8 and 9. The fourth general embodiment is discussed with reference to FIG. 10. The fifth general embodiment is discussed with reference to FIGS. 11 and 12. The sixth general embodiment is discussed with reference to FIG. 13. The seventh general embodiment is discussed with reference to FIG. 14.

Through all of the various embodiments and Figures, like reference numbers denote like components. In addition, the pedaling mechanism of the invention is symmetrical and includes a left portion and a right portion. The following detailed description of all of the various embodiments is directed to the components of the left portion although it is to be understood that the right portion includes like components that operate in a like fashion.

II. Detailed Description of the First General Embodiment

Referring now to the drawings in which like reference numerals designate like or corresponding parts throughout the several views, there is shown in FIGS. 1–6 the first general embodiment, which is the preferred embodiment of an exercise apparatus incorporating the unique features in accordance with the present invention which is designated generally by the reference numeral 10.

The exercise apparatus 10, as well as all of the various embodiments further described herein, include motion controlling components which operate in conjunction with the various pedal actuation assemblies and motion generating components to provide a pleasurable exercise experience for the user.

As illustrated in FIGS. 1–4, the exercise apparatus 10 includes a frame, shown generally at 12. The frame 12 includes vertical support members 14, 16A and 16B which are secured to a longitudinal support member 18. The frame 12 further includes cross members 20 and 22 which are also secured to and bisect the longitudinal support member 18. The cross members 20 and 22 are configured for placement on a floor 24. A pair of levelers 26 are secured to cross member 22 so that if the floor 24 is uneven, the cross member 22 can be raised or lowered such that the cross member 22, and the longitudinal support member 18 are substantially level. Additionally, a pair of wheels 28 are secured to the longitudinal support member 18 of the frame 12 at the rear of the exercise apparatus 10 so that the exercise apparatus 10 is easily moveable.

Figure 2:
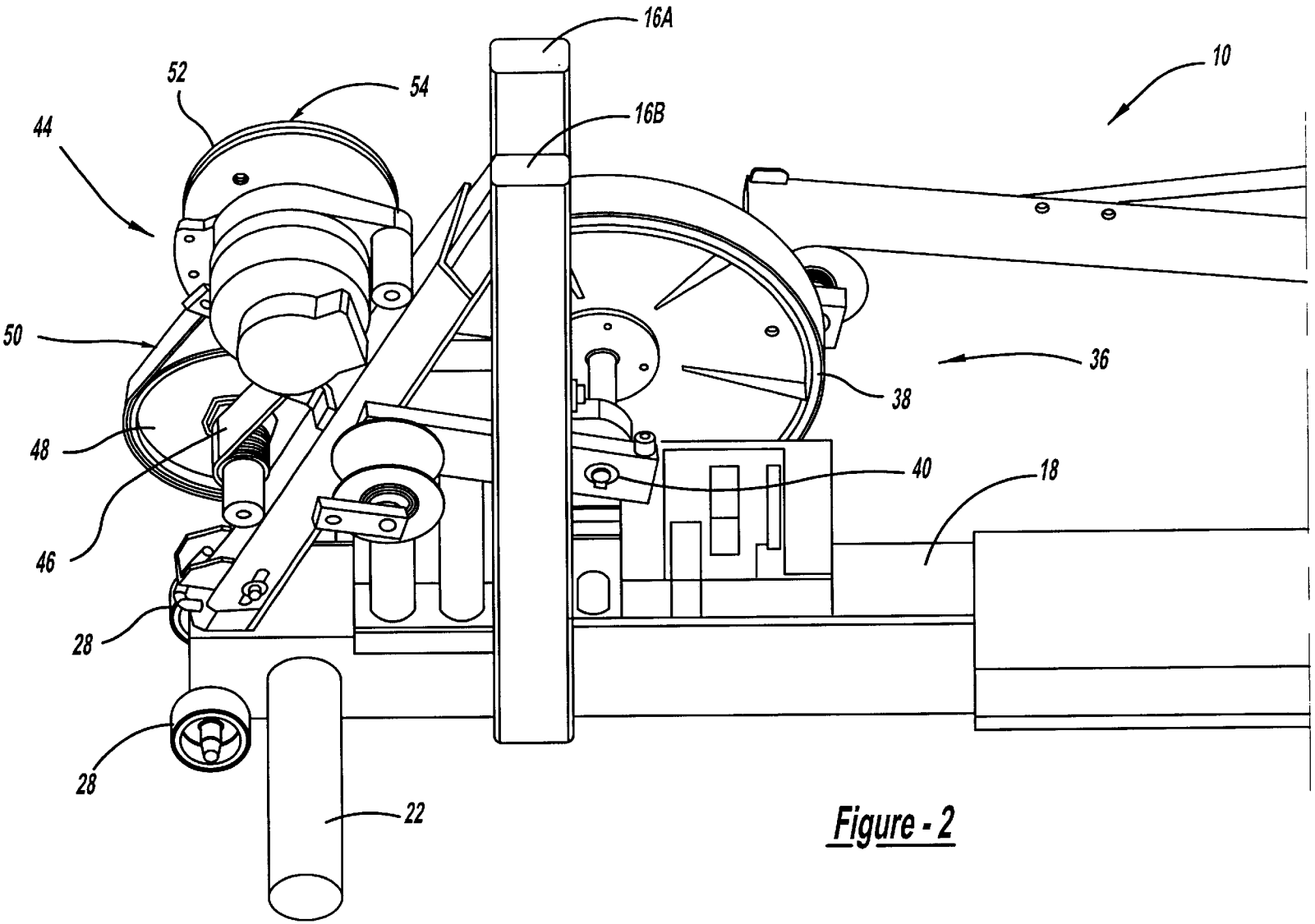
FIG. 2 is a partially cut-away top perspective view of the exercise apparatus in FIG. 1 showing the pulley, flywheel, alternator and transmission.
Figure 3:
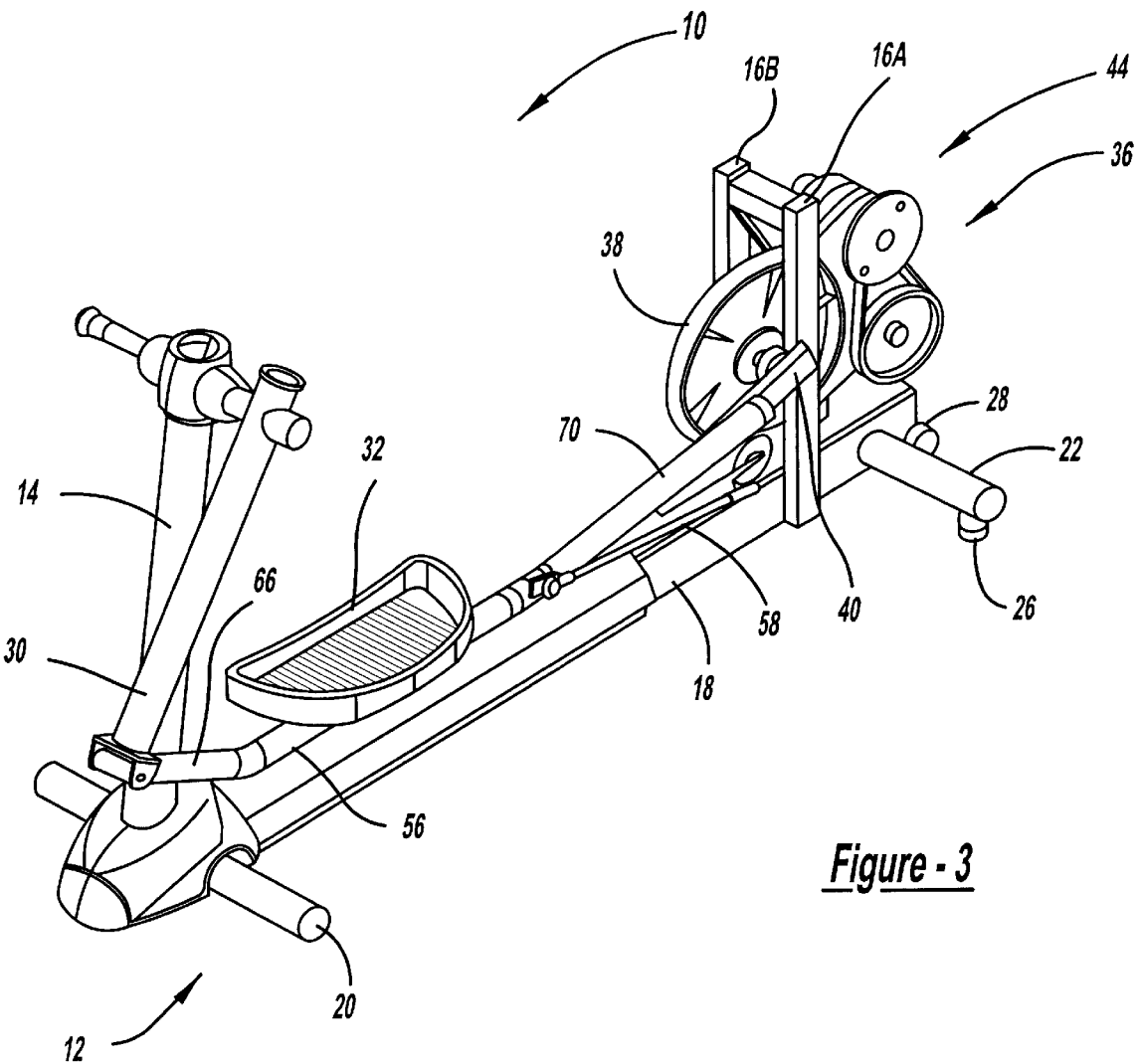
FIG. 3 is a partial cut-away top perspective view of the exercise apparatus in FIG. 1.
Figure 4:
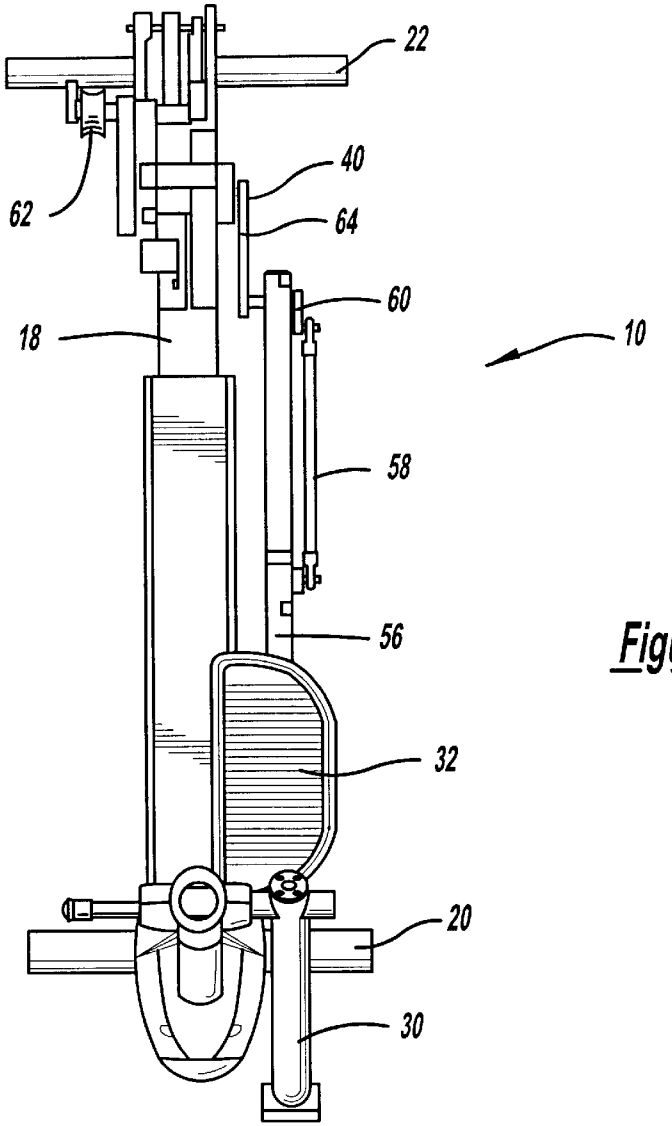
FIG. 4 is a partial cut-away top view of the exercise apparatus in FIG. 1.

The exercise apparatus 10 further includes a rocker 30, a pedal 32, a pedal actuation assembly 34 and a motion controlling assembly 36. As more fully illustrated in FIG. 2, the motion controlling assembly 36 includes a pulley 38 supported by vertical support members 16A and 16B around a pivot axle 40. The motion controlling assembly 36 also includes resistive force and control components, including an alternator 42 and a speed increasing transmission 44 that includes the pulley 38. The alternator 42 provides a resistive torque that is transmitted to the pedal 32 and to the rocker 30 through the speed increasing transmission 44. The alternator 42 thus acts as a brake to apply a controllable resistive force to the movement of the pedal 32 and the movement of the rocker 30. Alternatively, a resistive force can be provided by any suitable component, for example, by an eddy current brake, a friction brake, a band brake or a hydraulic braking system. Specifically, as best seen in FIG. 2, the speed increasing transmission 44 includes the pulley 38 which is coupled by a first belt 46 to a second double pulley 48. A second belt 50 connects the second double pulley 48 to a third pulley 52 that in turn is attached to a flywheel 54 of the alternator 42. The speed increasing transmission 44 thereby transmits the resistive force provided by the alternator 42 to the pedal 32 and the rocker 30 via the pulley 38. Since the speed increasing transmission 44 causes the alternator 42 to rotate at a greater rate than the pivot axle 40, the alternator 42 can provide a more controlled resistance force. Preferably the speed increasing transmission should increase the rate of rotation of the alternator 42 by a factor of 20 to 60 times the rate of rotation of the pivot axle 40 and in the preferred embodiment the pulleys 38 and 48 are sized to provide a multiplication in speed by a factor of 40. Also, size of the transmission 44 is reduced by providing a two stage transmission using pulleys 38 and 48 is used.

Figure 5:
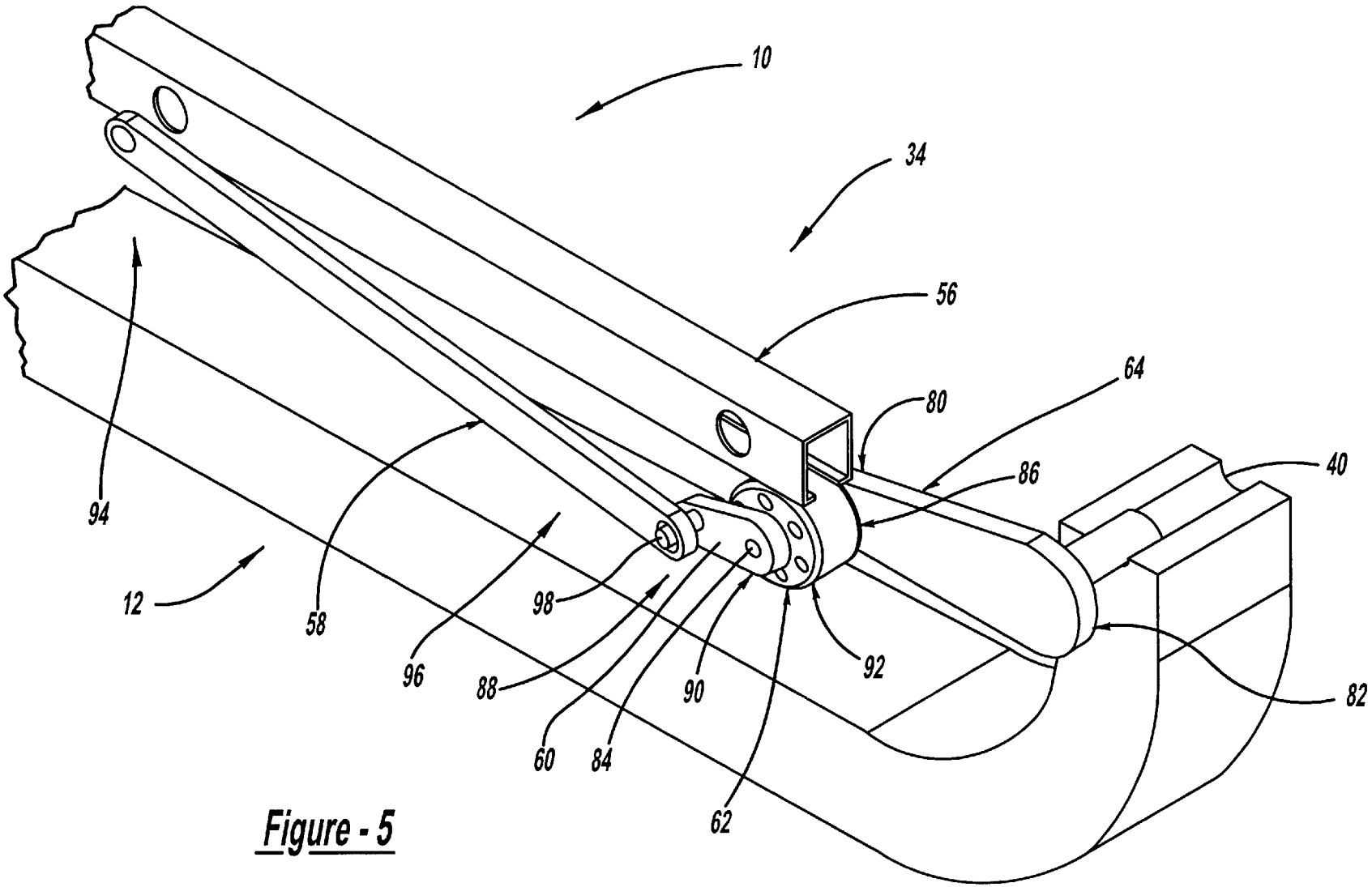
FIG. 5 is a partial simplified side perspective view of the stroke link, roller, pedal lever and double offset crank assembly of the exercise apparatus in FIG. 1.

As illustrated in FIGS. 1 and 5, the pedal actuation assembly 34 includes a pedal lever 56, a stroke link 58, an extension arm 60, a roller 62 and a crank 64. The pedal lever 56 is bent and includes a first portion 66, a second portion 68 and a third portion 70. The first portion 66 of the pedal lever 56 has a forward end 72. The first portion 66 of the pedal lever 56 is approximately 11 inches in length and upwardly extends from the second portion 68 at an angle of approximately 25°. The second portion 68 of the pedal lever 56 has a top surface 71 and a rearward end 74. The second portion 68 of the pedal lever 56 is approximately 26 inches in length. The pedal 32 is secured to the top surface 71 of the second portion 68 of the pedal lever 56 by any suitable securing means. In the preferred embodiment, the pedal 32 is secured such that the pedal 32 is substantially parallel to the second portion of the pedal lever 68. A bracket 76 is located at the rearward end 74 of the second portion 68 approximately 6¾ inches from the pedal 32. The third portion 70 of the pedal lever 56 has a rearward end 78. The third portion 70 of the pedal lever 56 is approximately 19½ inches in length and upwardly extends from the second portion 68 at an angle of approximately 9°. The bent pedal lever 56 allows a user to more easily mount the exercise apparatus 10.

Continuing, as illustrated in FIGS. 1 and 5, the crank 64 includes a forward end 80 and a rearward end 82. The rearward end 82 of the crank 64 is connected to and rotates about the pivot axle 40. A roller axle 84 is secured to the forward end 80 of the crank 64 to rotatably mount the roller 62 so that it can rotate about the roller axle 84. The extension arm 60 includes a forward end 88 and a rearward end 90. The rearward end 90 of the extension arm 60 is secured to and rotates about an outer surface 92 of the roller 62 about the roller axle 84. The stroke link 58 includes a forward end 94 and a rearward end 96. The rearward end 96 of the stroke link 58 is pivotally connected to the forward end 88 of the extension arm 60 at a pivot point 98 by any suitable connecting means. Moreover, the forward end 94 of the stroke link 58 is pivotally connected to the bracket 76 by any suitable connecting means.

The pedal 32 of the exercise apparatus 10 includes a toe portion 100 and a heel portion 102 so that the heel portion 102 is intermediate the toe portion 100 and the pivot axle 40. The pedal 32 of the exercise apparatus 10 also includes a top surface 103. As explained in more detail below, in reference to FIG. 6, the pedal 32 is secured to the top surface 71 of the pedal lever 56 in a manner so that the desired foot weight distribution and flexure are achieved when the pedal 32 travels in a substantially elliptical pathway 104 (shown in FIG. 6) as the rearward end 78 of the third portion 70 of the pedal lever 56 rolls on top of the roller 62, travelling in a rotationally arcuate pathway with respect to the pivot axle 40 and in the preferred embodiment moves in an elliptical pathway 106 (shown in FIG. 6) around the pivot axle 40. Since the rearward end 78 of the pedal lever 56 is not maintained at a predetermined distance from the pivot axis 40 but instead follows the elliptical pathway 106, a more refined foot motion is achieved. In the preferred embodiment, the rearward end 78 of the third portion 70 of the pedal lever 56 can move in two ways in the elliptical pathway 106 around the pivot axle 40. First, the rearward end 78 of the third portion 70 of the pedal lever 56 can move counterclockwise in the elliptical pathway 106, as seen from the user's left side. When the rearward end 78 of the third portion 70 of the pedal lever 56 travels counterclockwise in the elliptical pathway 106, the pedal 32 travels in a direction along the elliptical pathway 104 that simulates a forward-stepping motion. In the forward-stepping mode, as the pedal 32 moves in the elliptical pathway 104, the heel portion 102 is lowered below the toe portion 100 when the forward end 72 of the first portion 66 of the pedal lever 56 moves in a reciprocating arcuate pathway 108 in a direction towards the pivot axle 40. Second, the rearward end 78 of the third portion 70 of the pedal lever 56 can move clockwise in the elliptical pathway 106, as seen from the user's left side. When the rearward end 78 of the third portion 70 of the pedal lever 56 travels clockwise in the elliptical pathway 106, the pedal 32 travels in a direction along the elliptical pathway 104 that simulates a backward-stepping motion. In the backward-stepping mode, as the pedal 32 moves in the elliptical pathway 104, the heel portion 102 of the pedal 32 is raised above the toe portion 100 of the pedal 32 when the forward end 72 of the first portion 66 of the pedal lever 56 moves in the reciprocating arcuate pathway 108 in a direction towards the pivot axle 40.

In the preferred embodiment, the exercise apparatus 10 also includes an upper handle 110 as shown in FIGS. 6A–6H. The upper handle 110 is rigidly attached to an upper portion 112 of the rocker 30. The upper portion 112 of the rocker 30 is pivotally attached to an axle 114 at a pivot point or hub 116. The axle 114 bisects and is connected to the vertical support member 14 of the frame 12. A lower portion 118 of the rocker 30 is pivotally connected to the forward end 72 of the first portion 66 of the pedal lever 56 at a pivot point 120.

During operation, the rocker 30 swings forward and aft, causing the forward end 72 of the first portion 66 of the pedal lever 56 to travel forward and aft along the reciprocating pathway 108. As the upper handle 110 moves, as indicated by a line 121, toward the rearward end 78 of the third portion 70 of the pedal lever 56, the rearward end 78 of the third portion 70 of the pedal lever 56 moves in the elliptical pathway 106 towards the pivot axle 40. In the reverse direction, as the rearward end 78 of the third portion 70 of the pedal lever 56 moves away from the pivot axle 40, the upper handle 110 moves towards the pivot axle 40. In the preferred embodiment, the upper handle includes a hand grip 122 portion that extends from the upper handle 110 at a predetermined angle which is selected to promote ergonomic efficiency. It has also been found that the arm motion feels best when the rocker 30 and the upper handle 110 are approximately the same length. More particularly, the most desirable feel to the user results when the range of motion of the rocker 30 at pivot point 120 is approximately equal to the range of motion of the portion of the arm handle 110 having the hand grip 122. By using the pedal lever 56 having a bent first portion 66, it is possible to size the rocker 30 so as to provide optimum upper arm movement. For example, if the pedal lever 56 were straight, without changing the length of the rocker 30 or the upper handle 110, the user would tend to grasp the upper handle 110 at a point higher up which would result in a range of arm motion that would be too great. Similarly, if the pedal lever 56 were straight, and the length of the rocker 30 were to be increased, the user could grasp the upper handle 110 at the same point 122 as the apparatus 10 shown in FIGS. 1–6, but this would result in an undesirable decrease in the range of arm motion. It will also be appreciated that the stroke link 58 primarily controls the horizontal movement of the pedal lever 56. The geometry of the pedal actuation assembly 34 is such that the horizontal movement of the pedal lever 56 is greater than the vertical movement and preferably, the rocker 56 and upper handle are approximately equal so as to provide the optimum foot and arm motion.

The contributions of the components of the pedal actuation assembly 34 to the desired elliptical motion are now explained generally with reference to FIG. 6. As the pulley 38 rotates about the pivot axle 40, the rearward end 78 of the third portion 70 of the pedal lever 56 moves in the generally elliptical pathway 106 due to the coupling between the pivot axle 40, the crank 64, the roller 62 and the rearward end 78 of the third portion 70 of the pedal lever 56. The forward end 72 of the first portion 66 of the pedal lever 56, however, is constrained to move in the arcuate pathway 108, due to the pivotal connection between the forward end 72 of the first portion 66 of the pedal lever 56 and the rocker 30. Consequently, as the rearward end 78 of the third portion 70 of the pedal lever 56 moves in the elliptical pathway 106, the forward end 72 of the first portion 66 of the pedal lever 56 moves in the reciprocating arcuate pathway 108. The translation from the elliptical motion of the rearward end 78 of the third portion 70 of the pedal lever 56 to the reciprocating arcuate motion of the forward end 72 of the first portion 66 of the pedal lever 56 provides a substantially elliptical motion intermediate the rearward end 78 of the third portion 70 of the pedal lever 56 and the forward end 72 of the first portion 66 of the pedal lever 56. Consequently, the pedal 32, which is coupled to the top surface 71 of the pedal lever 56 intermediate the rearward end 78 of the third portion 70 of the pedal lever 56 and the forward end 72 of the first portion 66 of the pedal lever 56 moves in the substantially elliptical pathway 104 as shown in FIG. 6. The horizontal dimension of the elliptical pathway 104 is determined by the major diameter of the elliptical pathway 106. The vertical dimension of the elliptical pathway 104 is determined by the exact location of the pedal 32 on the pedal lever 56, and the minor diameter of the elliptical pathway 106. Specifically, the motion of the pedal 32 approaches a more elliptical motion the closer the pedal 32 is to the third portion 70 of the pedal lever 56 and the motion of the pedal 32 approaches a more arcuate motion the closer the pedal 32 is to the first portion 66 of the pedal lever 56. Consequently, the height of the elliptical pathway 104 can be changed by changing the location of the pedal 32 along the top surface 71 of the pedal lever 56.

The movement of the pedal 32, which is determined by the components of the pedal actuation assembly 34, is now discussed in detail with reference to the simplified functional schematic drawings labeled as FIGS. 6A–6H. FIGS. 6A–6H trace the motion of the pedal 32 as the pedal 32 completes one forward-stepping revolution along the elliptical pathway 104, beginning at the rearmost position of the reciprocating arcuate pathway 108 of the first portion 66 of the pedal lever 56. As previously stated, the exercise apparatus 10 can be operated both in a forward-stepping mode and in a backward-stepping mode. When the exercise apparatus 10 is operated in the forward-stepping mode, the pedal 32 travels in a counterclockwise sequence as illustrated in FIGS. 6A–6H. Alternatively, when the exercise apparatus 10 is operated in the backward-stepping mode, the sequence of the pedal 32 is reversed so that the pedal 32 moves from the starting point, shown in FIG. 6A, in a clockwise direction to the position shown in FIG. 6H.

Figure 6A:
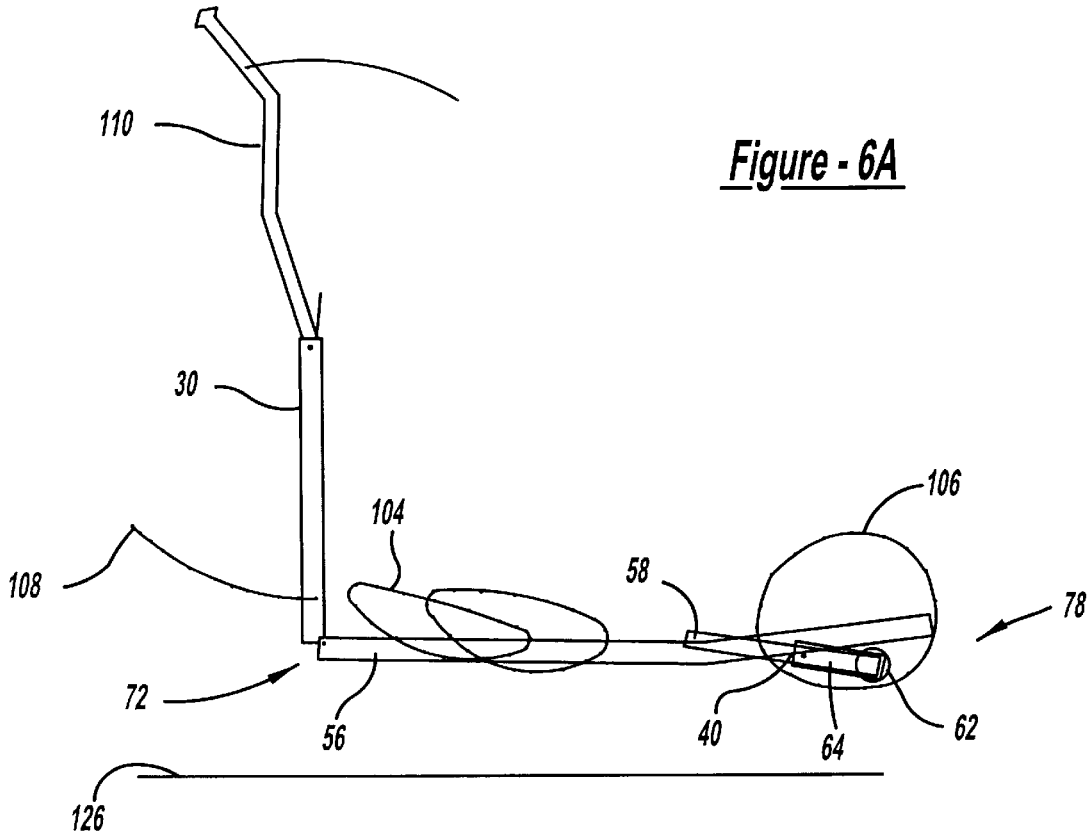
FIGS. 6A–6H are simplified functional schematic representations of the reciprocating movement of the second end of the pedal lever and illustrations of the elliptical pathway traced by the pedal as the second end of the pedal lever completes its elliptical reciprocating path of travel.

Beginning at FIG. 6A, the forward end 72 of the first portion 66 of the pedal lever 56 is at the rearmost position on the arcuate pathway 108. As noted previously, the rearward end 78 of the third portion 70 of the pedal lever 56 moves in the reciprocating elliptical pathway 106 as the forward end 72 of the first portion 66 of the pedal lever 56 moves in the reciprocating arcuate pathway 108. Consequently, the movement of the rearward portion 78 of the third portion 70 of the pedal lever 56 generates a varying angular displacement 124 between the pedal lever 56 and a fixed, horizontal reference plane 126. When the forward end 72 of the first portion 66 of the pedal lever 56 is at the rearmost position on the reciprocating arcuate pathway 108, the angular displacement 124 between the pedal lever 56 and the reference plane 126 is 5.7°. In addition, an angular displacement 128 between the top surface 103 of the pedal 32 and the horizontal reference plane 126 is 5.7° while an angle 130 between the top surface 103 of the pedal 32 and the top surface 71 of the pedal lever 56 is 0°. Moreover, a linear displacement 132 between a point 134 on the top surface 103 of the pedal 32 and the horizontal reference plane 126 is about 9.8 inches.

Figure 6B:
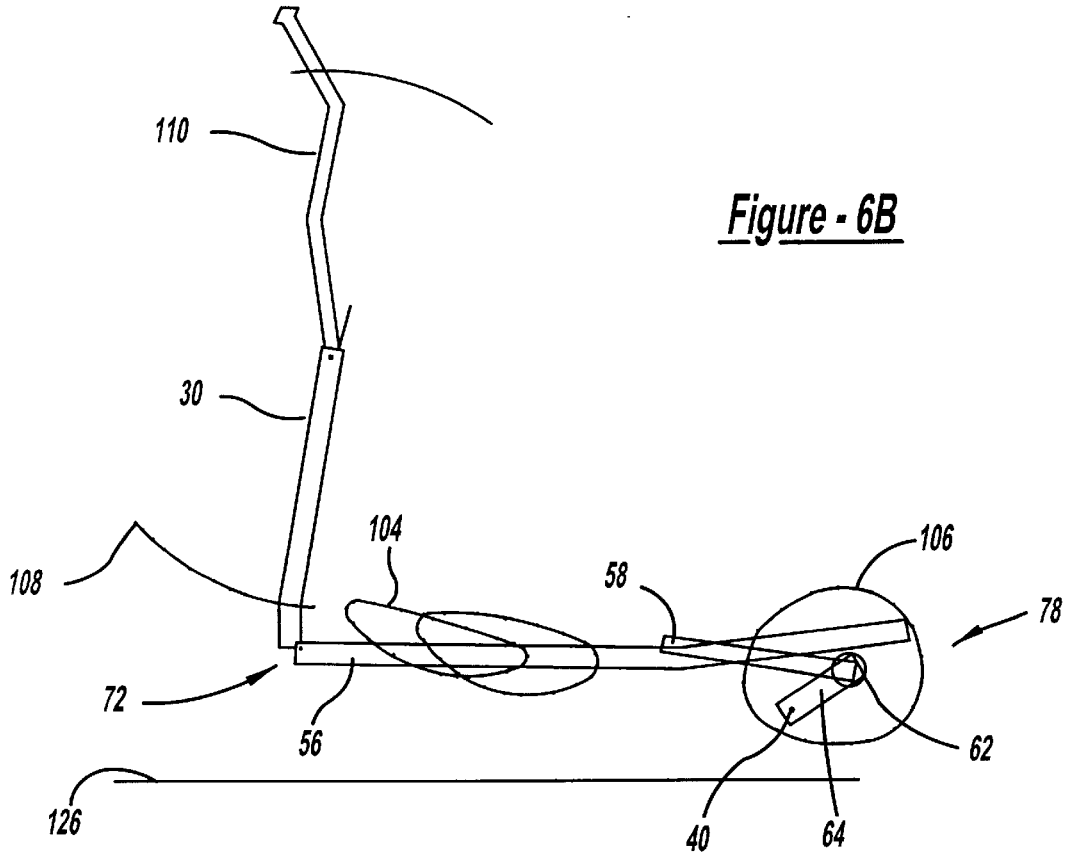

As the pedal 32 is moved by the user in the forward-stepping mode, rotation of the pulley 38 on the pivot axle 40 by about 45° moves the pedal 32 to the position shown in FIG. 6B. The forward end 72 of the first portion 66 of the pedal lever 56 has advanced about one-fourth of the distance along the reciprocating arcuate pathway 108 away from the pivot axle 40. At this point, the varying angular displacement 128 between the top surface 103 of the pedal 32 and the horizontal reference plane 126 is about 11.0° while the angle 130 between the top surface 103 of the pedal 32 and the top surface 71 of the pedal lever 56 remains 0°. In addition, the linear displacement 132 between the point 134 and the horizontal reference plane 126 has increased to about 11.5 inches while the angular displacement 124 between the pedal lever 56 and the horizontal reference plane 126 has increased to about 11.0°. This change in the angular displacement 128 also corresponds to a flexure of the foot in which the toe portion 100 of the pedal 32 is being raised above the heel portion 102 of the pedal 32. The weight distribution and flexure thus provided by the pedal actuation assembly 34 corresponds to that of the normal human gait.

Figure 6C:
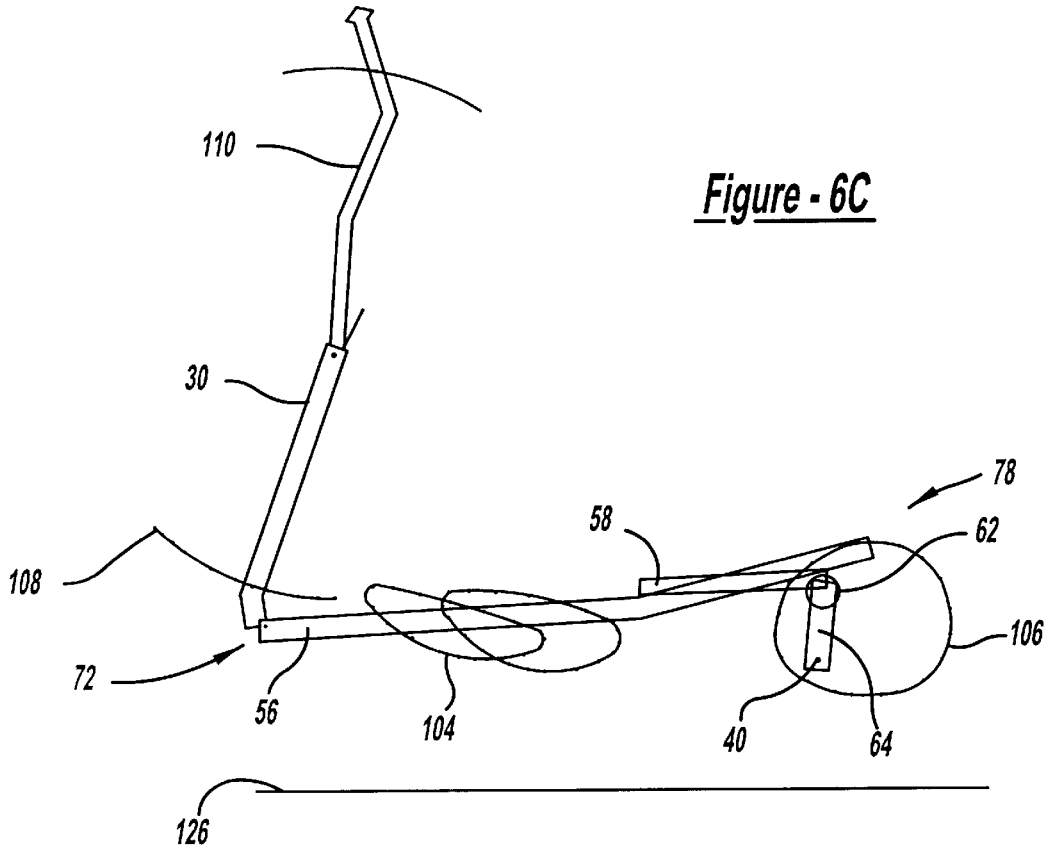

Forward rotation of the pulley 38 on the pivot axle 40 by about another 45° brings the pedal 32 to the position shown in FIG. 6C, at which point the forward end 72 of the first portion 66 of the pedal lever 56 has traveled about half-way along the reciprocating arcuate pathway 108 away from the pivot axle 40. At this point, the varying angular displacement 128 between the top surface 103 of the pedal 32 and the horizontal reference plane is about 12.3° while the angle 130 between the top surface 103 of the pedal 32 and the top surface 71 of the pedal lever 56 remains 0°. In addition, the linear displacement 132 between the point 134 and the horizontal reference plane 126 has increased to about 12.4 inches while the angular displacement 124 between the top surface 71 of the pedal lever 56 and the horizontal reference plane 126 has increased to about 12.3°. This change in the angular displacement 128 also corresponds to the flexure in which the toe portion 100 of the pedal 32 is being raised even higher than the heel portion 102 of the pedal 32 as would occur in a normal non-assisted forward-stepping gait.

Figure 6D:
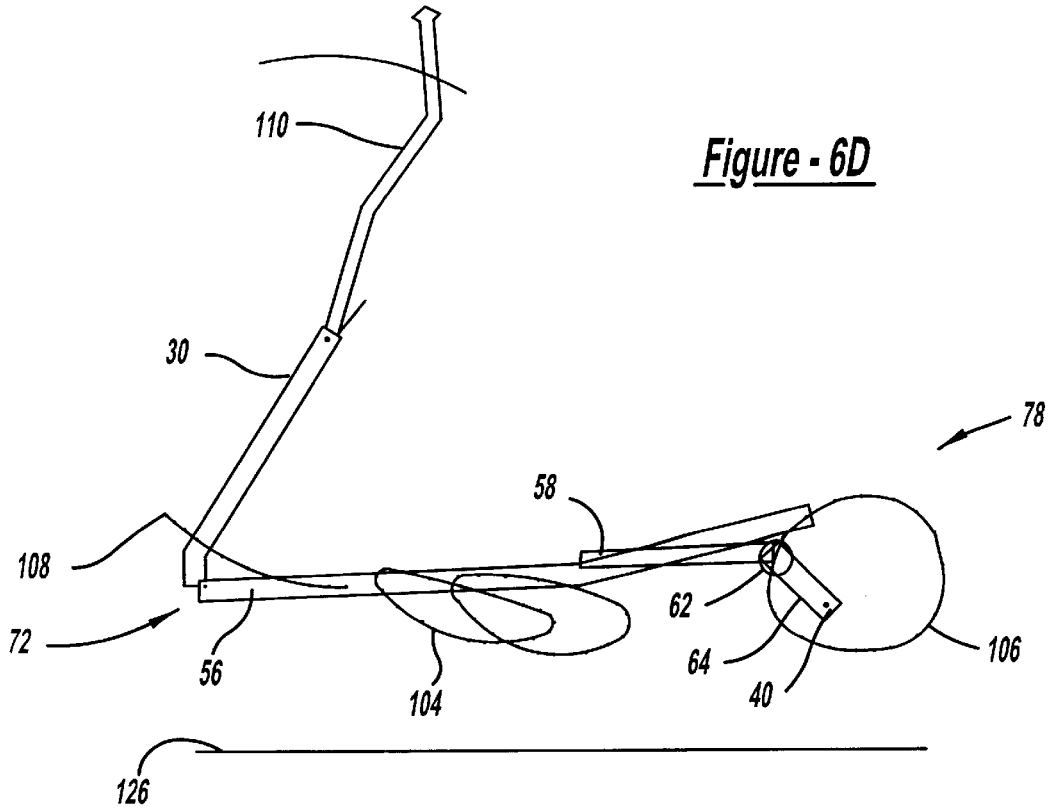

Forward rotation of the pulley 38 on the pivot axle 40 by about another 45° brings the pedal 32 to the position shown in FIG. 6D, at which point the forward end 72 of the first portion 66 of the pedal lever 56 has traveled about three-fourths the distance along the reciprocating arcuate pathway 108 away from the pivot axle 40. At this point, the varying angular displacement 128 between the top surface 103 of the pedal 32 and the horizontal reference plane 126 is about 7.1° while the angle 130 between the top surface 103 of the pedal 32 and the top surface 71 of the pedal lever 56 remains 0°. In addition, the linear displacement 132 between the point 134 and the horizontal reference plane 126 has increased to about 13.0 inches while the angular displacement 124 between the top surface 71 of the pedal lever 56 and the horizontal reference plane 126 has decreased to about 7.1°.

Figure 6E:
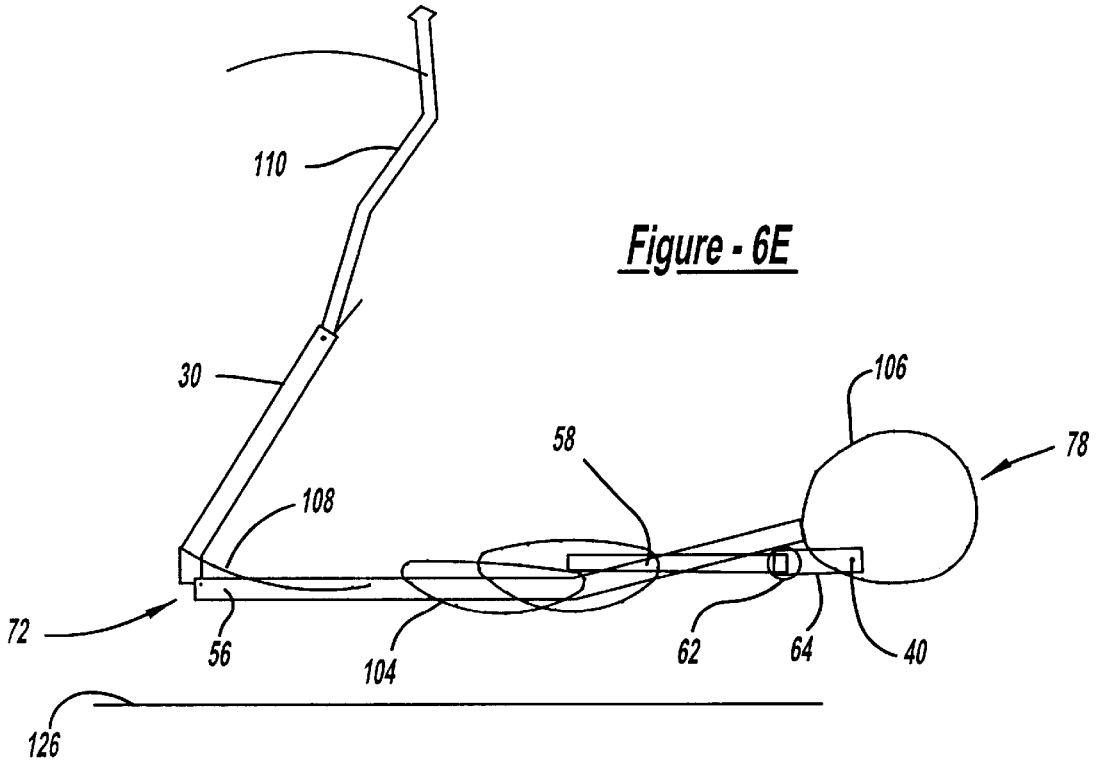

Continued rotation of the pulley 38 on the pivot axle 40 by about another 45° brings the pedal 32 to the position shown in FIG. 6E, where the forward end 72 of the first portion 66 of the pedal lever 56 has traveled the entire distance along the reciprocating arcuate pathway 108. The varying angular displacement 128 has now changed to about 0.4°, while the angle 130 remains 0°. The linear displacement 132 between the top surface 103 of the pedal 32 and the horizontal reference plane 126 has decreased to about 12.2 inches and the angular displacement 128 between the top surface 71 of the pedal lever 56 and the horizontal reference plane 126 has decreased to about 0.4°.

Figure 6F:
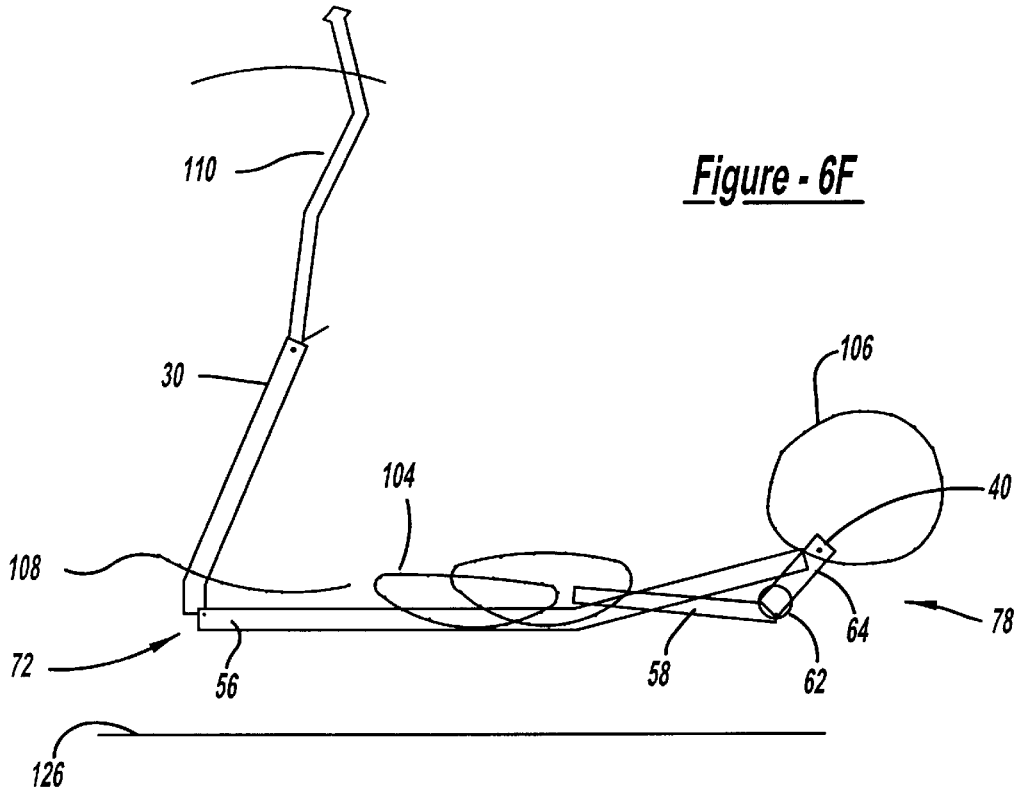

Forward rotation of the pulley 38 on the pivot axle 40 by about another 45° moves the forward end 72 of the first portion 66 of the pedal lever 56 backwards by about one-fourth of the distance along the reciprocating arcuate pathway 108, toward the pivot axle 40, and brings the pedal 32 to the position shown in FIG. 6F. Although the angle 130 between the top surface 103 of the pedal 32 and top surface 71 of the pedal lever 56 remains 0°, the angular displacement 128 between the top surface 103 of the pedal 32 and the horizontal reference plane 126 has decreased to about −2.7°. The linear displacement 132 between the point 134 and the horizontal reference plane 126 has decreased to about 9.3 inches and the angular displacement 124 between the top surface 71 of the pedal lever 56 and the horizontal reference plane 126 has decreased to about −2.7°. The pedal 32 is now in the lower portion of the elliptical pathway 104 which corresponds to the second half of the forward-stepping motion.

Figure 6G:
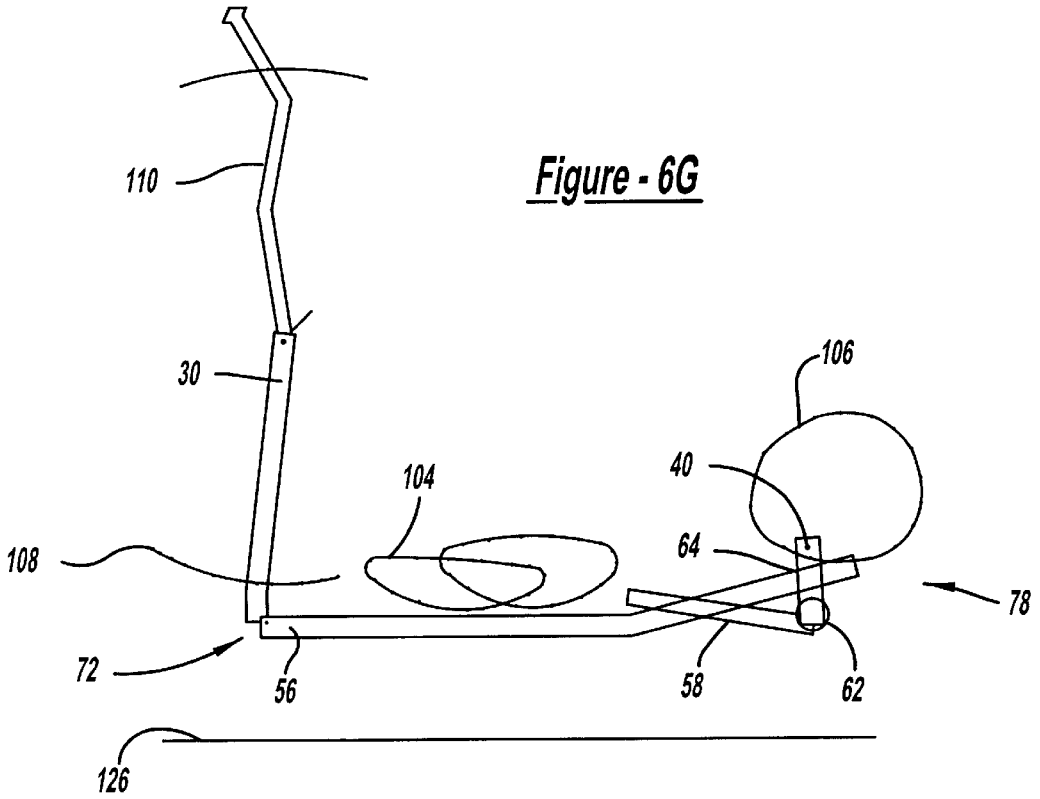

Continued rotation of the pulley 38 on the pivot axle 40 by about another 45°0 brings the pedal 32 to the position shown in FIG. 6G, at which point the forward end 72 of the first portion 66 of the pedal lever 56 has traveled backwards about half-way along the reciprocating arcuate pathway 108 towards the pivot axle 40. The angular displacement 128 between the top surface 103 of the pedal 32 and the horizontal reference plane 126 has increased to about −2.3° although the angle 130 remains 0°. The linear displacement 132 between the point 134 and the horizontal reference plane 126 has decreased even further, to about 7.3 inches, and the angular displacement 124 between the top surface 71 of the pedal lever 56 and the horizontal reference plane 126 has increased to about −2.3°.

Figure 6H:
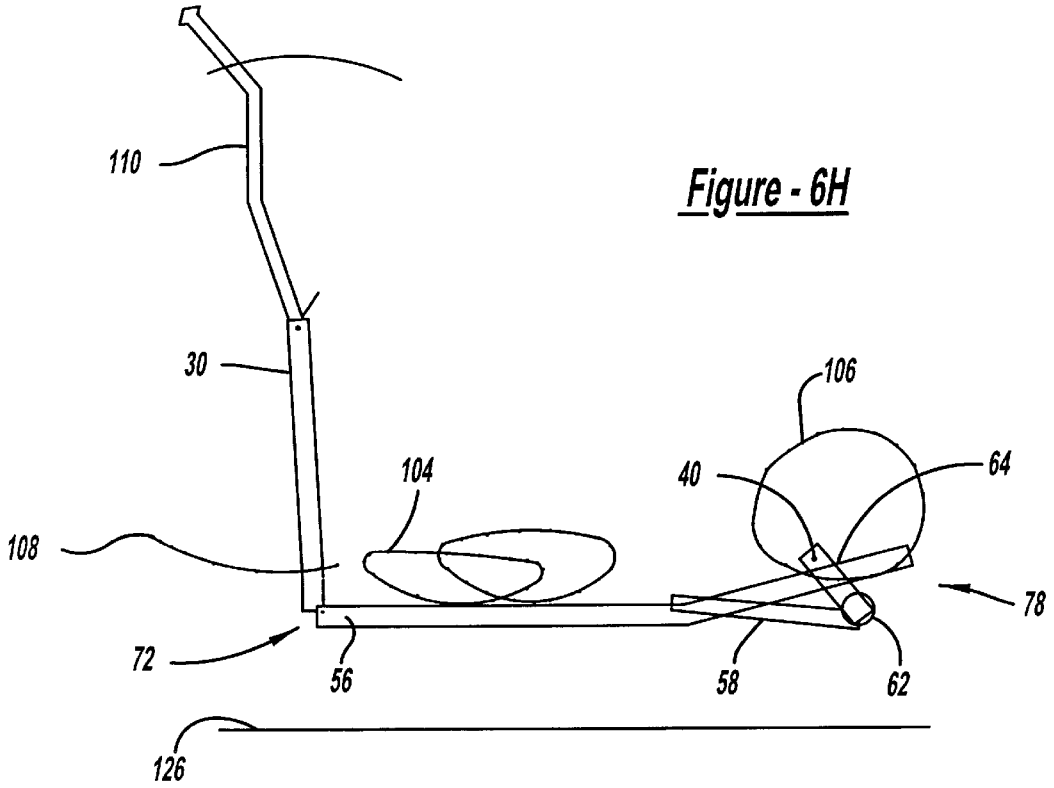

Forward rotation of the pulley 38 on the pivot axle 40 by about another 45° moves the forward end 72 of the first portion 66 of the pedal lever 56 backwards to a position that is about three-fourths of the distance along the reciprocating arcuate pathway 108, towards the pivot axle 40, and brings the pedal 32 to the position shown in FIG. 6H. Even though the angle 130 between the top surface 103 of the pedal 32 and the top surface 71 of the pedal lever 56 remains 0°, the angular displacement 128 between the top surface 103 of the pedal 32 and the horizontal reference plane 126 has increased to about 0.5°. In addition, the linear displacement 132 between the point 134 on the top surface 103 of the pedal 32 and the horizontal reference plane 126 has increased to about 7.8 inches and the angular displacement 124 between the top surface 71 of the pedal lever 56 and the horizontal reference plane 126 has increased to about 0.5°. Continued rotation of the pulley 38 on the pivot axle 40 by about another 45° completes the forward-stepping motion along the elliptical pathway 104 and brings the forward end 72 of the first portion 66 of the pedal lever 56 back to the rearmost position along the reciprocating arcuate pathway 105 and the pedal 32 back to the position shown in FIG. 6A.

The foregoing examples of displacements and angles represent a preferred motion of the pedal 32. It should be understood, however, that these motions can be changed by varying various parameters of the pedal actuation assembly 34 such as the lengths of the crank 64 and the length of the extension arm 60 as well as changing the relative height of the pivot axle 40.

As a result of the bent pedal lever 56, the exercise apparatus 10 is easy for the user to mount. When the user then operates the pedal 32 in the previously described manner, the pedal 32 moves along the elliptical pathway 104 in a manner that stimulates a natural heel to toe flexure that minimizes or eliminates stresses due to the unnatural foot flexures. If the user employees the moving upper handle 110, the exercise apparatus 10 exercises the user's upper body concurrently with the user's lower body thereby providing a total cross-training workout. The exercise apparatus 10 thus provides a wide variety of exercise programs that can be tailored to the specific needs and desires of individual users, and consequently, enhances exercise efficiency and promotes a pleasurable exercise experience.

III. Detailed Description of the Second General Embodiment

Figure 7:
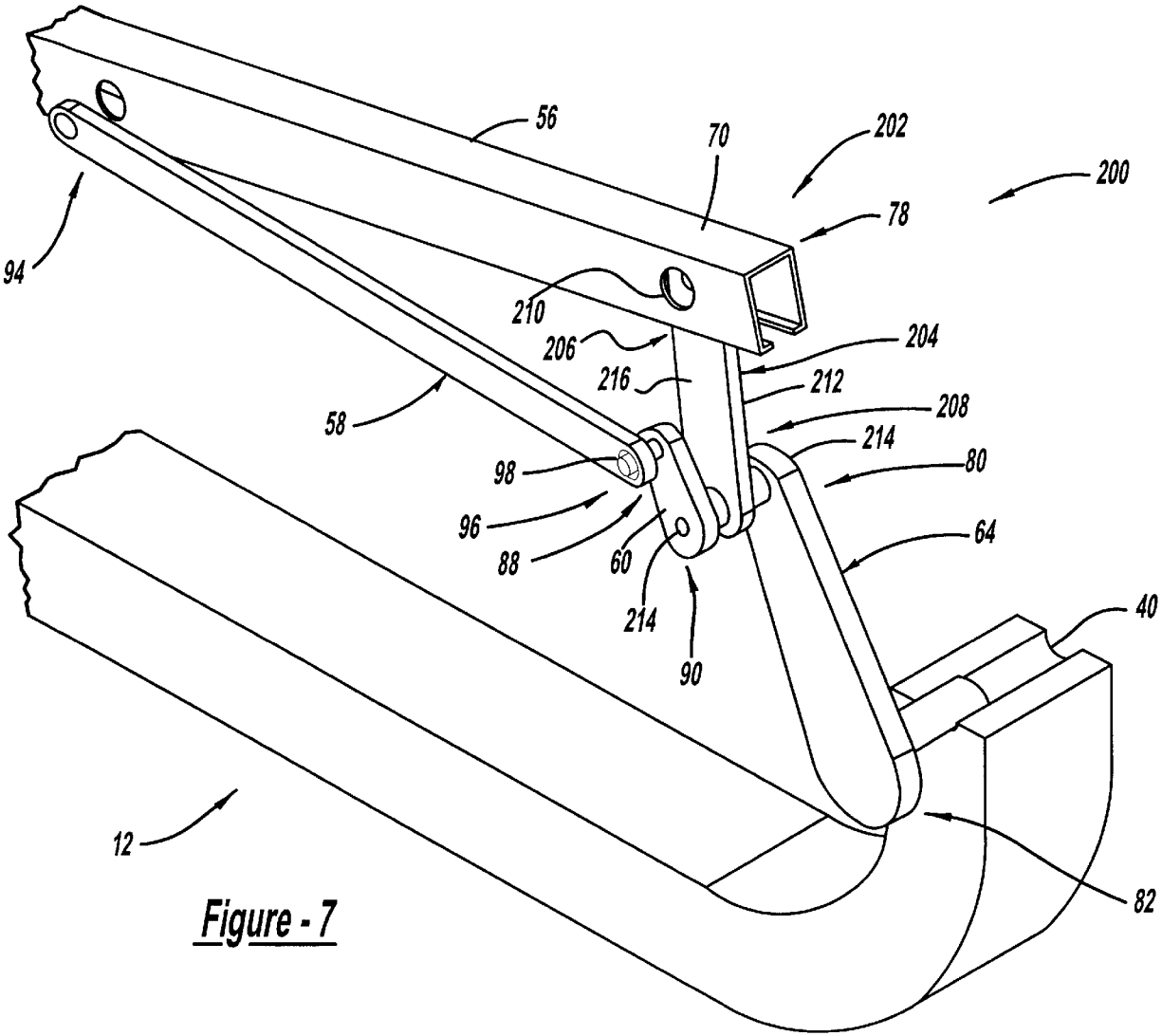
FIG. 7 is a partial simplified side perspective view of a second embodiment of an exercise apparatus according to the invention.

FIG. 7 shows a second general embodiment of an exercise apparatus 200 according to the invention. As noted previously, the second embodiment of the exercise apparatus 200 of the invention includes a second type of pedal actuation assembly and therefore implements the desired elliptical pedal motion in a similar fashion as the exercise apparatus 10. As with the exercise apparatus 10, the exercise apparatus 200 includes, but is not limited to, the frame 12, the pedal 32, the pulley 38 and associated pivot axle 40, the pedal lever 56, the upper handle 110, and the various motion controlling components, such as the alternator 42 and the transmission 44. The exercise apparatus 200 differs primarily from the exercise apparatus 10, along with the various embodiments that follow, in the nature and construction of the pedal actuation assembly. As noted earlier, the pedal actuation assembly refers to those components which cooperate to (1) provide an elliptical path and (2) provide the desired foot flexure and weight distribution on the pedal 32.

The pedal actuation assembly 202 of the exercise apparatus 200 includes the stroke link 58, the extension arm 60, the crank 64 and a rise link 204. Similar to the pedal actuation assembly 34, in the pedal actuation assembly 202, the rearward end 82 of the crank 64 is pivotally attached to and rotates about the pivot axle 40. Additionally, the forward end 94 of the stroke link 58 is pivotally attached to the pedal lever 56 by any suitable securing means. The rearward end 96 of the stroke link 58 is pivotally attached to and rotates about the forward end 88 of the extension arm 60 at the pivot point 98.

The rise link 204 of the pedal actuation assembly 202 includes an upper portion 206 and a lower portion 208. The upper portion 206 of the rise link 204 is pivotally connected to the rearward end 78 of the third portion 70 of the pedal lever 56 at a pivot point 210. The forward end 80 of the crank 64 is pivotally connected to and rotates about the lower portion 208 of the rise link 204 on an inner portion 212 of the rise link 204 at a pivot point or shaft 214. The rearward end 90 of the extension arm 60 similarly pivots about and is connected to the lower portion 208 of the rise link 204 on an outer portion 216 of the rise link 204 at the pivot point or shaft 214. Thus, the significant difference between the pedal actuation assembly 202 of the exercise apparatus 200 and the pedal actuation assembly 34 of the exercise apparatus 10 is that the pedal lever 56 of the exercise apparatus 10 rests on the roller 62 while the pedal lever 56 of the exercise apparatus 200 is pivotally attached to the rise link 204.

During operation, the rise link 204 of the pedal actuation assembly 202 of the exercise apparatus 200 controls the vertical movement of the third portion 70 of the pedal lever 56. Similarly to the exercise apparatus 10, in the exercise apparatus 200, the stroke link 58 primarily controls the horizontal movement of the pedal lever 56. The geometry of the pedal actuation assembly 202 of the exercise apparatus 200 is such that the horizontal movement of the pedal lever 56 is greater than the vertical movement.

When the user operates the exercise apparatus 200 as described, the pedal 32 moves along the elliptical pathway 104 in a manner that simulates a natural heel to toe flexure that minimizes or eliminates stresses due to unnatural foot flexure. The exercise apparatus 200 thus also provides a wide variety of exercise programs that can be tailored to the specific needs and desires of individual users, and consequently, enhances exercise efficiency and promotes a pleasurable exercise experience.

IV. Detailed Description of the Third Embodiment

Figure 8:
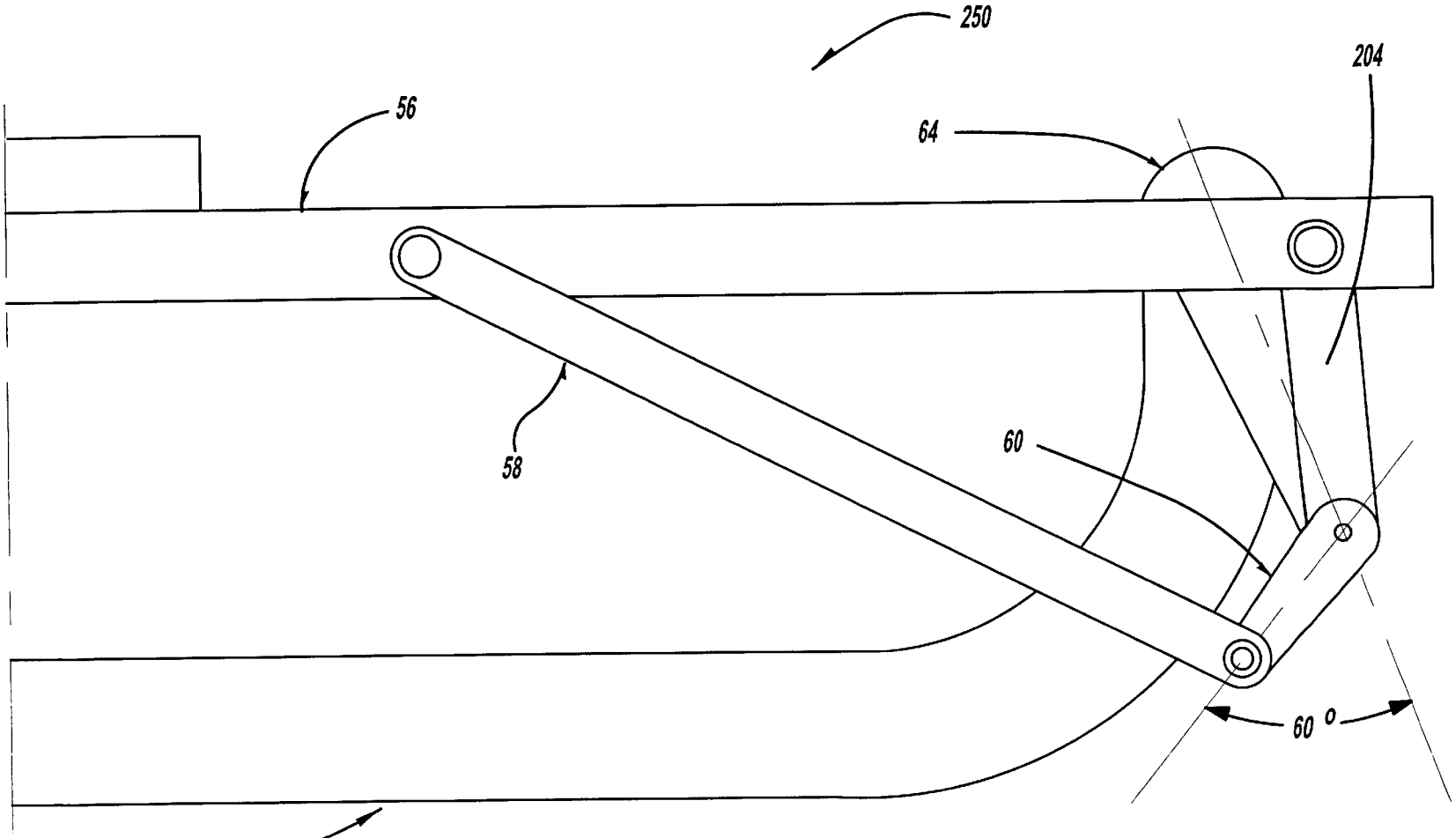
FIG. 8 is a partial simplified side view of a third embodiment of an exercise apparatus according to the invention.
Figure 9:
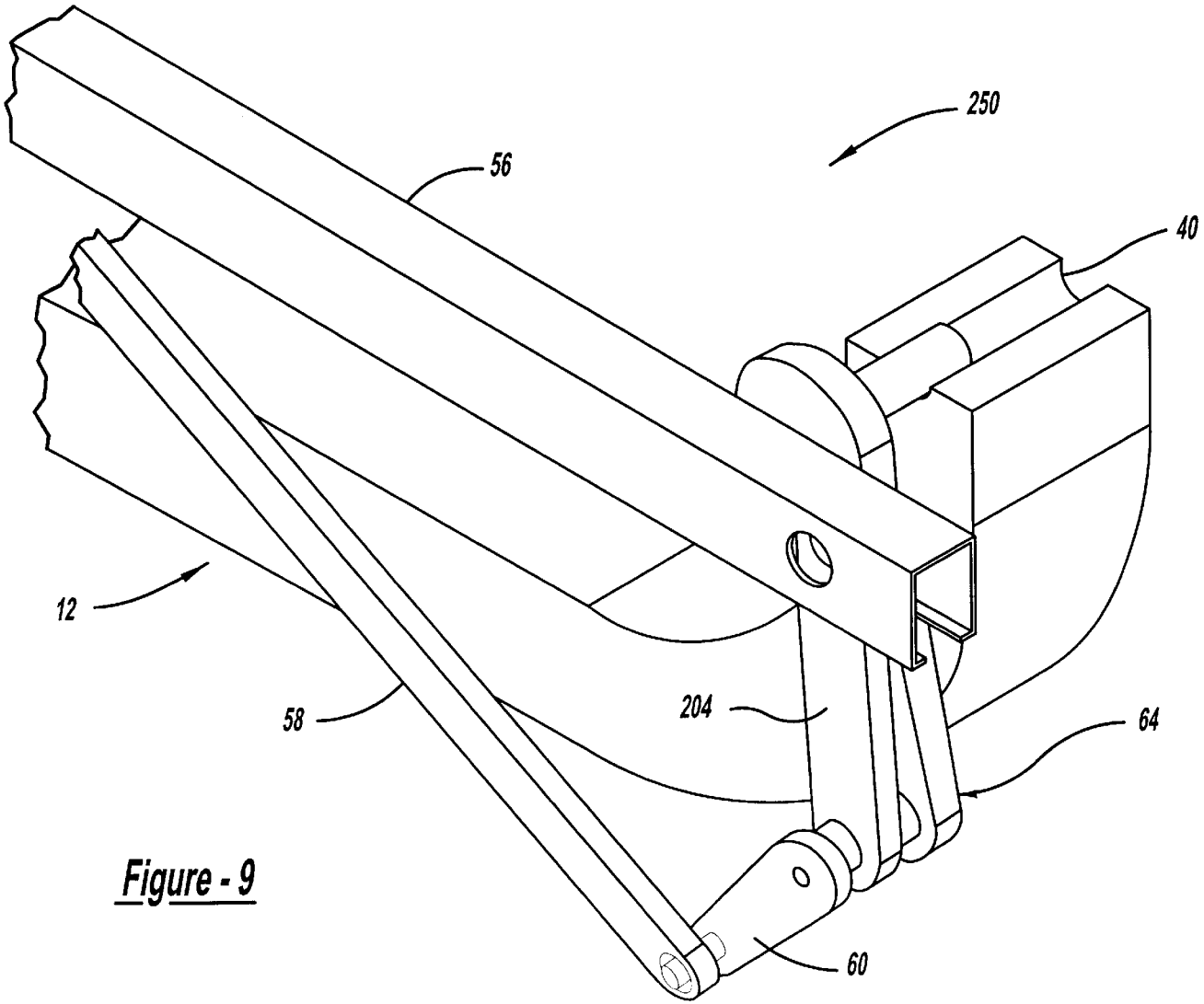
FIG. 9 is a partial simplified side perspective view of the exercise apparatus in FIG. 8.

FIGS. 8–9 show a third general embodiment of an exercise apparatus 250 according to the invention. As noted previously, the third embodiment of the exercise apparatus 250 of the invention includes a third type of pedal actuation assembly and therefore implements the desired elliptical pedal motion in a similar fashion as the exercise apparatuses 10 and 200. As with the previous embodiments of the exercise apparatuses 10 and 200, the exercise apparatus 250 includes, but is not limited to, the frame 12, the pedal 32, the pulley 38 and associated pivot axle 40, the pedal lever 56, and the various motion controlling components, such as the alternator 42 and the transmission 44. The exercise apparatus 250 differs primarily from the exercise apparatus 10 and 200 along with the various embodiments that follow, in the nature and construction of the pedal actuation assembly.

Specifically, a pedal actuation assembly 252 of the exercise apparatus 250 is identical to the pedal actuation assembly 202 of the exercise apparatus 200 except that the crank 64 has been displaced at an angle relative to the extension arm 60 to modify the motion of the pedal lever 56. As shown in FIGS. 8 and 9, the extension arm 60 is displaced approximately 60° relative to the crank 64. Thus, as the crank 64 rotates counterclockwise, the crank 64 will be time phased ahead of the extension arm 60. Changing the fixed angle between the crank 64 and the extension arm 60 offers a method for tuning the motion of the pedal 32.

Thus, when the user operates the exercise apparatus 250 as described above, the pedal 32 moves along the elliptical pathway 104 in a manner that simulates a natural heel to toe flexure that minimizes or eliminates stresses due to unnatural foot flexures. The exercise apparatus 250 thus also provides a wide variety of exercise programs that can be tailored to the specific needs and desires of individual users, and consequently, enhances exercise efficiency and promotes a pleasurable exercise experience.

IV. Detailed Description of the Fourth General Embodiment

Figure 10:
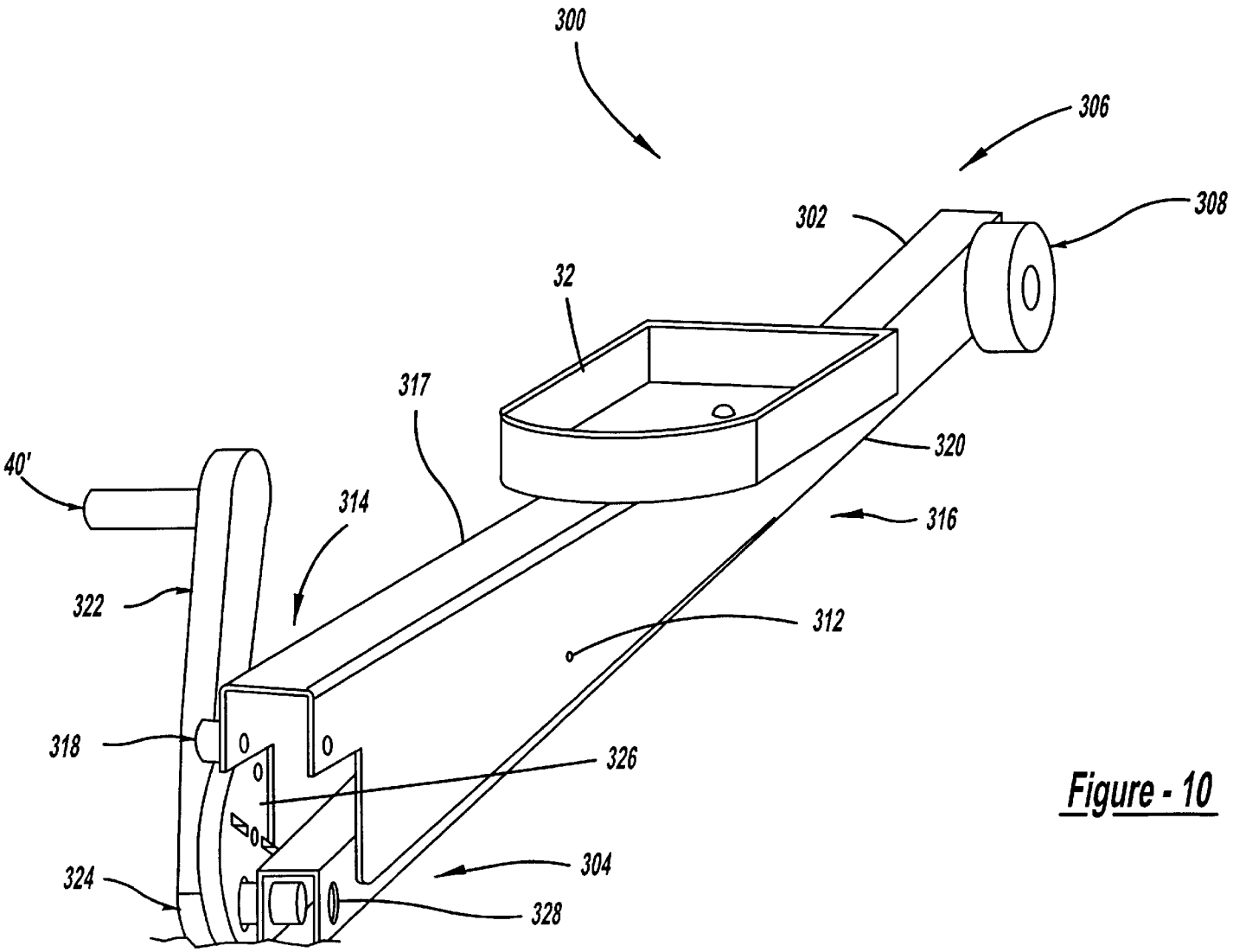
FIG. 10 is a partial simplified perspective view of a fourth embodiment of an exercise apparatus according to the invention.

FIG. 10 shows a fourth embodiment of an exercise apparatus 300 according to the invention. As noted previously, the fourth embodiment of the exercise apparatus 300 of the invention include a fourth type of pedal actuation assembly and therefore implements the desired elliptical pedal motion in a similar fashion as the exercise apparatuses 10, 200 and 250. As with the previous exercise apparatuses 10, 200 and 250, the exercise apparatus 300 includes, but is not limited to, the frame 12, the pedal 32, the pulley 38 and associated pivot axle 40' (which corresponds generally in function to the pivot axle 40 described in the previous embodiments), and the various motion controlling components, such as the alternator 42 and the transmission 44.

As shown in FIG. 10, the exercise apparatus 300 differs primarily from the previous exercise apparatuses 10, 200 and 250, along with the various embodiments that follow, in that the crank is positioned in front of the user. The exercise apparatus 300 includes a pedal lever 302 having a forward end 304 and a rearward end 306. Attached to the rearward end 306 of the pedal lever 302 is a roller 308 which rides in a track 310. The track 310 is attached to the frame 12. The exercise apparatus 300 further includes a pedal mount link 312 having a forward end 314, a rearward end 316 and an upper surface 317. A cam follower 318 is rotatably attached to the forward end 314 of the pedal mount link 312. The rearward end 316 of the pedal mount link 312 is pivotally connected to the pedal lever 302 at a pivot point 320. The pedal 32 is rigidly attached to the upper surface 317 of the pedal mount link 312. The exercise apparatus 300 further includes a crank 322 having a lower end 324. Bolted to the crank 322 is a cam 326. The lower end 324 of the crank 322 and the cam 326 are pivotally attached to the forward end 304 of the pedal lever 302 at a pivot point 328. Moreover, the cam 326 contacts the cam follower 318 on the pedal mount link 312.

As the crank 322 rotates, the pedal lever 302 is caused to reciprocate. Moreover, as the crank 322 rotates, the cam 326 and the cam follower 318 cause the pedal mount link 312 and the pedal lever 302 to articulate relative to one another. The exercise apparatus 300 offers the advantage of having a crank connected directly to the pedal lever. This direct connection better stabilizes the pedal lever, which allows using one roller instead of two. The purpose for introducing the pedal mount link 312 and the cam 326 is to provide a means for tuning the motion of the pedal 32. Similarly, when the user operates the pedal 32 in the above-described manner, the pedal 32 moves along the elliptical pathway 104 in a manner that simulates a natural heel to toe flexure that minimizes or eliminates stresses due to unnatural foot flexures. The exercise apparatus 300 thus provides a wide variety of exercise programs that can be tailored to the specific needs and desires of individual users, and consequently, enhances exercise efficiency and promotes a pleasurable exercise experience.

V. Detailed Description of the Fifth General Embodiment

Figure 11:
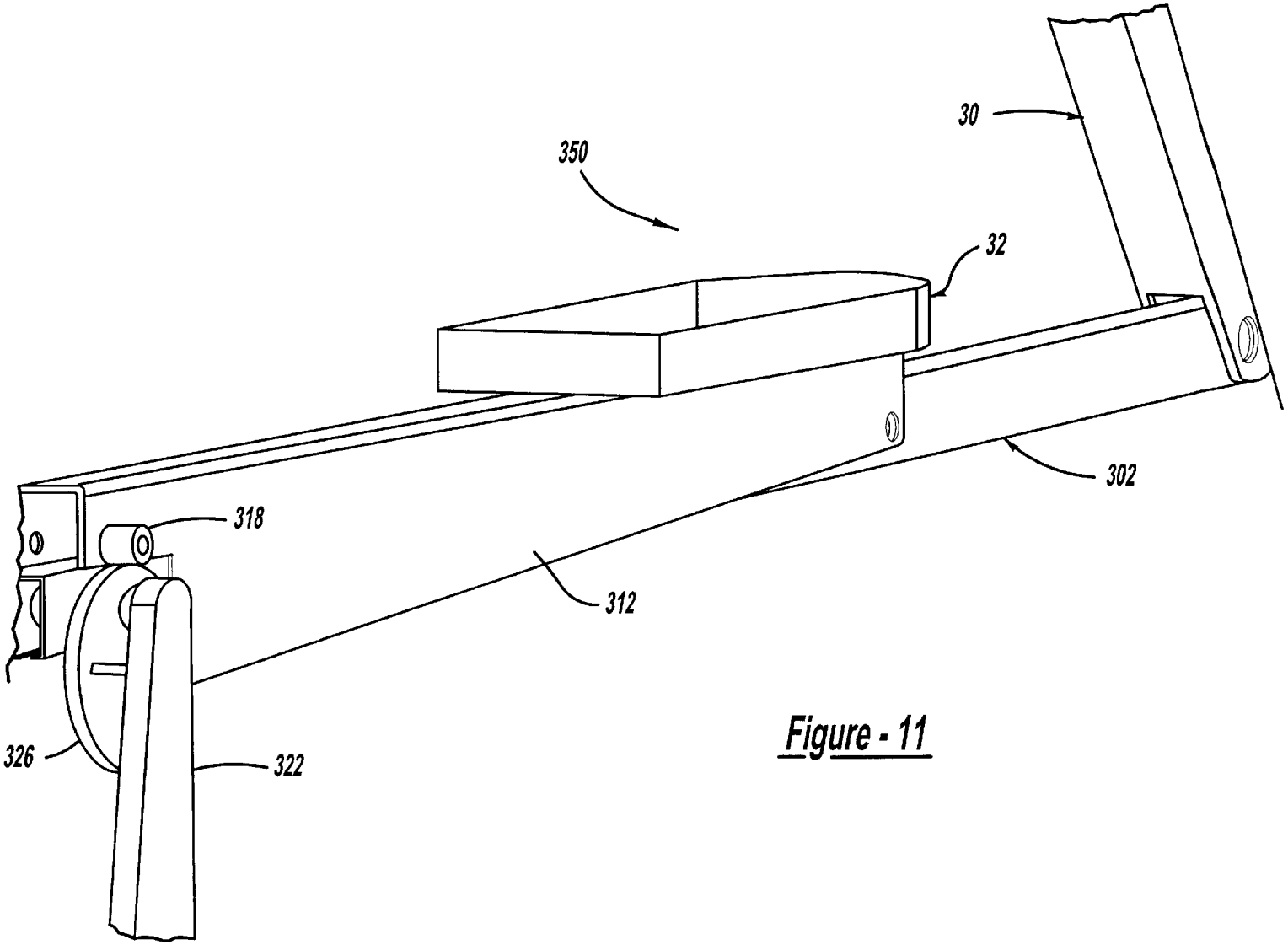
FIG. 11 is a partial simplified side perspective view of a fifth embodiment of an exercise apparatus according to the invention.
Figure 12:
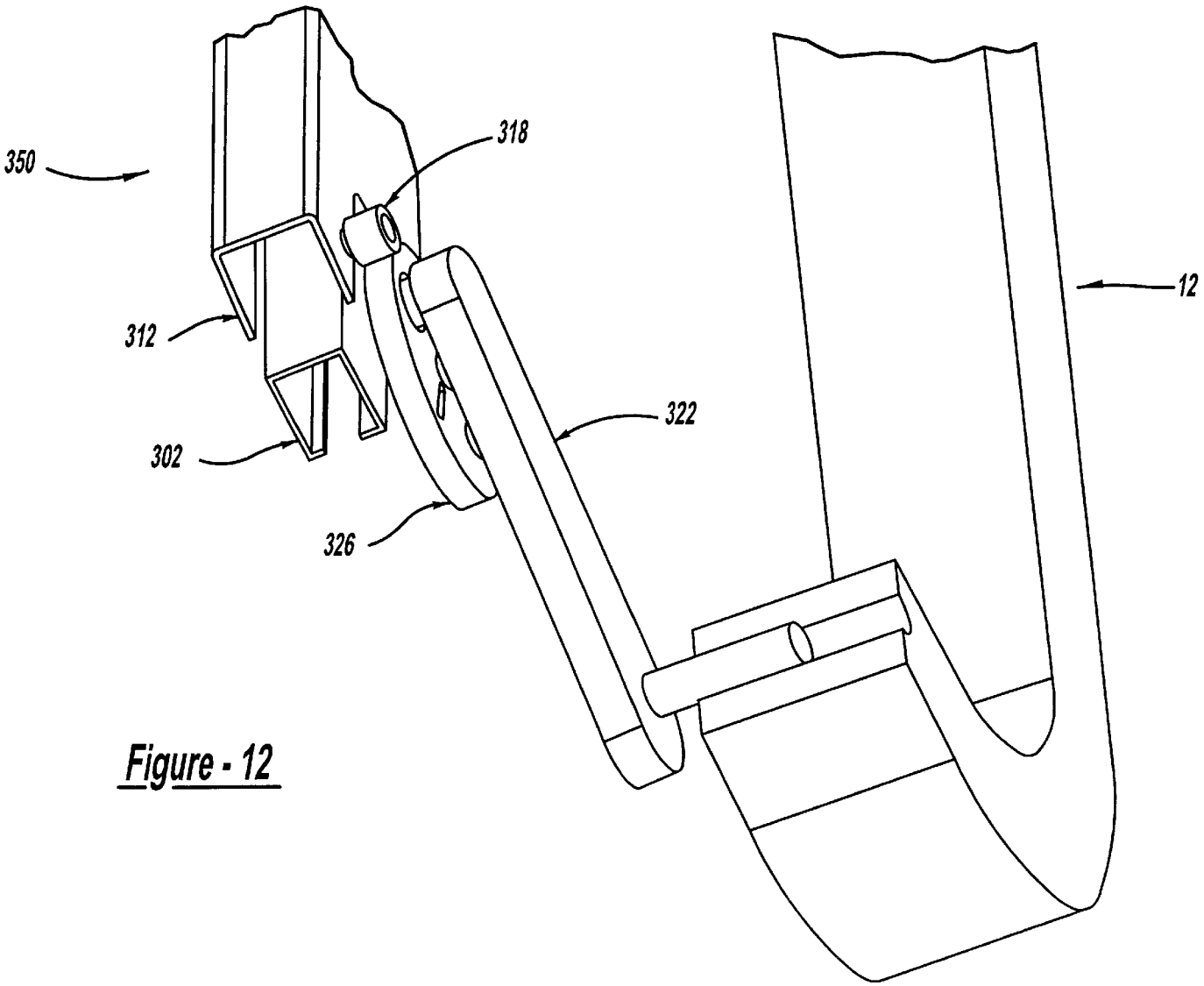
FIG. 12 is a partial simplified rear perspective view of the exercise apparatus in FIG. 11.

FIGS. 11 and 12 show a fifth general embodiment of an exercise apparatus 350 according to the invention. As noted previously, the fifth embodiment of the exercise apparatus 350 of the invention includes a fifth type of pedal actuation assembly and therefore implements the desired elliptical pedal motion in a similar fashion as the exercise apparatuses 10, 200, 250 and 300. As with the previous exercise apparatuses 10, 200, 250 and 300, the exercise apparatus 350 includes, but is not limited to, the frame 12, the pedal 32, the pulley 38 and associated pivot axle 40, and the various motion controlling components, such as the alternator 42 and the transmission 44. The exercise apparatus 350 is also similar to the exercise apparatus 300 including, but not limited to, the pedal lever 302, the pedal mount link 312, the cam follower 318, the crank 322 and the cam 326. The major difference between the exercise apparatus 300 and the exercise apparatus 350 are that the above described components are behind the user in the exercise apparatus 350 instead of in front of the user in the exercise apparatus 300. As illustrated, the exercise apparatus 350 also replaces the roller 308 and the track 310 of the exercise apparatus 300 with the rocker 30. As previously discussed, the rocker 30 is pivotally attached to the frame 12.

In the exercise apparatus 350, the cam 326 aids in fine tuning the motion of the pedal 32, particularly the heel to toe flexure relationship. When the user operates the pedal 32 in the previously described manner, the pedal 32 moves along the elliptical pathway 104 in a manner that simulates a natural heel to toe flexure that minimizes or eliminates stresses due to the unnatural foot flexures. Thus, the exercise apparatus 350 similarly provides a wide variety of exercise programs that can be tailored to the specific needs and desires of individual users, and consequently, enhances exercise efficiency and promotes a pleasurable exercise experience.

VI. Detailed Description of the Sixth General Embodiment

Figure 13:
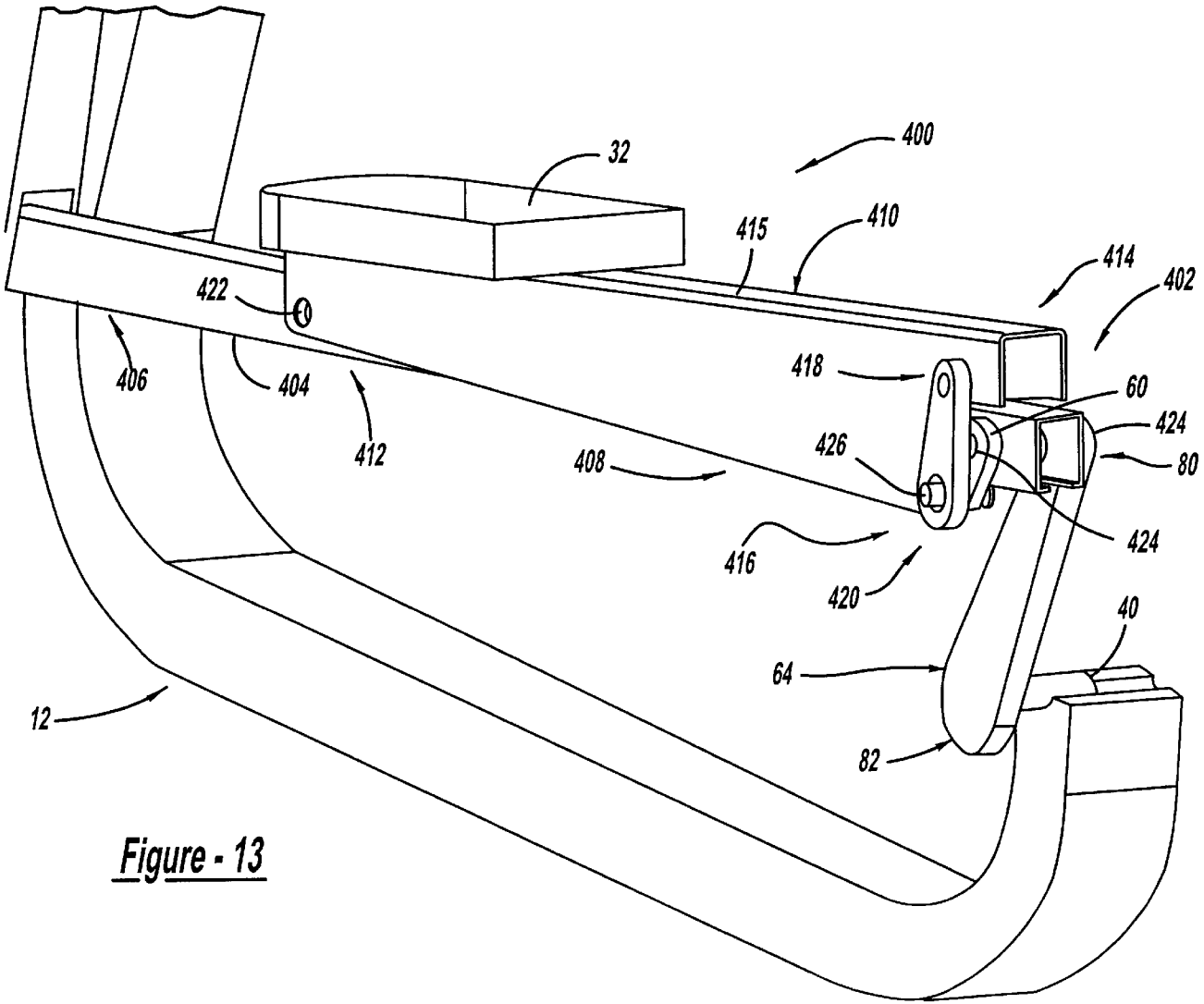
FIG. 13 is a partial simplified side perspective view of a sixth embodiment of an exercise apparatus according to the invention.

FIG. 13 shows a sixth general embodiment of an exercise apparatus 400 according to the invention. As noted previously, the exercise apparatus 400 of the invention includes a sixth type of pedal actuation assembly and therefore implements the desired elliptical pedal motion in a similar fashion as the exercise apparatuses 10, 200, 250, 300 and 350. As with the previous exercise apparatuses 10, 200, 250, 300 and 350, the exercise apparatus 400 includes, but is not limited to, the frame 12, the pedal 32, the pulley 38 and associated pivot axle 40, and the various motion controlling components, such as the alternator 42 and the transmission 44. The exercise apparatus 400 differs primarily from the previous exercise apparatuses 10, 200, 250, 300 and 350, along with the embodiment that follows, in the nature and construction of the pedal actuation assembly. As noted earlier, the pedal actuation assembly refers to those components which cooperate to (1) provide an elliptical path and (2) provide the desired foot flexure and weight distribution of the pedal 32.

A pedal actuation assembly 402 of the exercise apparatus 400 includes a pedal lever 404 having a forward end 406 and a rearward end 408, a pedal mount link 410 having a forward end 412, a rearward end 414 and a top surface 415, and a pickle link 416 having an upper portion 418 and a lower portion 420. The pedal actuation assembly 402 of the exercise apparatus 400 further includes the rocker 30, the pedal 32, the extension arm 60, and the crank 64. The forward end 406 of the pedal lever 404 is pivotally connected to the rocker 30. As previously set forth above, the rocker 30 is then pivotally attached to the frame 12. The pedal 32 is rigidly attached to the top surface 415 of the pedal mount link 410. The forward end 412 of the pedal mount link 410 is pivotally attached to the pedal lever 404 at a pivot point 422.

As explained in more detail above, the rearward end 82 of the crank 64 is pivotally connected to the pivot axle 40. The forward end 80 of the crank 64 is pivotally connected to the rearward end 408 of the pedal lever 404 at a pivot point 424. The rearward end 90 of the extension arm 60 is similarly pivotally connected to the rearward end 408 of the pedal lever 404 at the pivot point 424. The forward end 88 of the extension arm 60 is pivotally connected to the lower portion 420 of the pickle link 416 at a pivot point 426. The upper portion 418 of the pickle link 416 is pivotally connected to the rearward end 414 of the pedal mount link 410 by any suitable connecting means.

The exercise apparatus 400 produces a similar motion as the exercise apparatuses 300 and 350 having the cam 326. As the crank 64 rotates, the pickle link 416 and the extension arm 60 cause the pedal mount link 410 and the pedal lever 404 to articulate relative to one another. The longer the extension arm 60, the more the pedal mount link 410 will articulate relative to the pedal lever 404. Thus, the pedal actuation assembly 402 of the exercise apparatus 400 provides a means for tuning the motion of the pedal 32.

In this regard, when the user operates the pedal 32 in the previously described manner, the pedal 32 moves along the elliptical pathway 104 in a manner that stimulates a natural heel to toe flexure that minimizes or eliminates stresses due to unnatural foot flexure. Similarly, the exercise apparatus 400 thus provides a wide variety of exercise programs that can be tailored to the specific needs and desires of individual users, and consequently, enhances exercise efficiency and promotes a pleasurable exercise experience.

VII. Detailed Description of the Seventh General Embodiment

Figure 14:
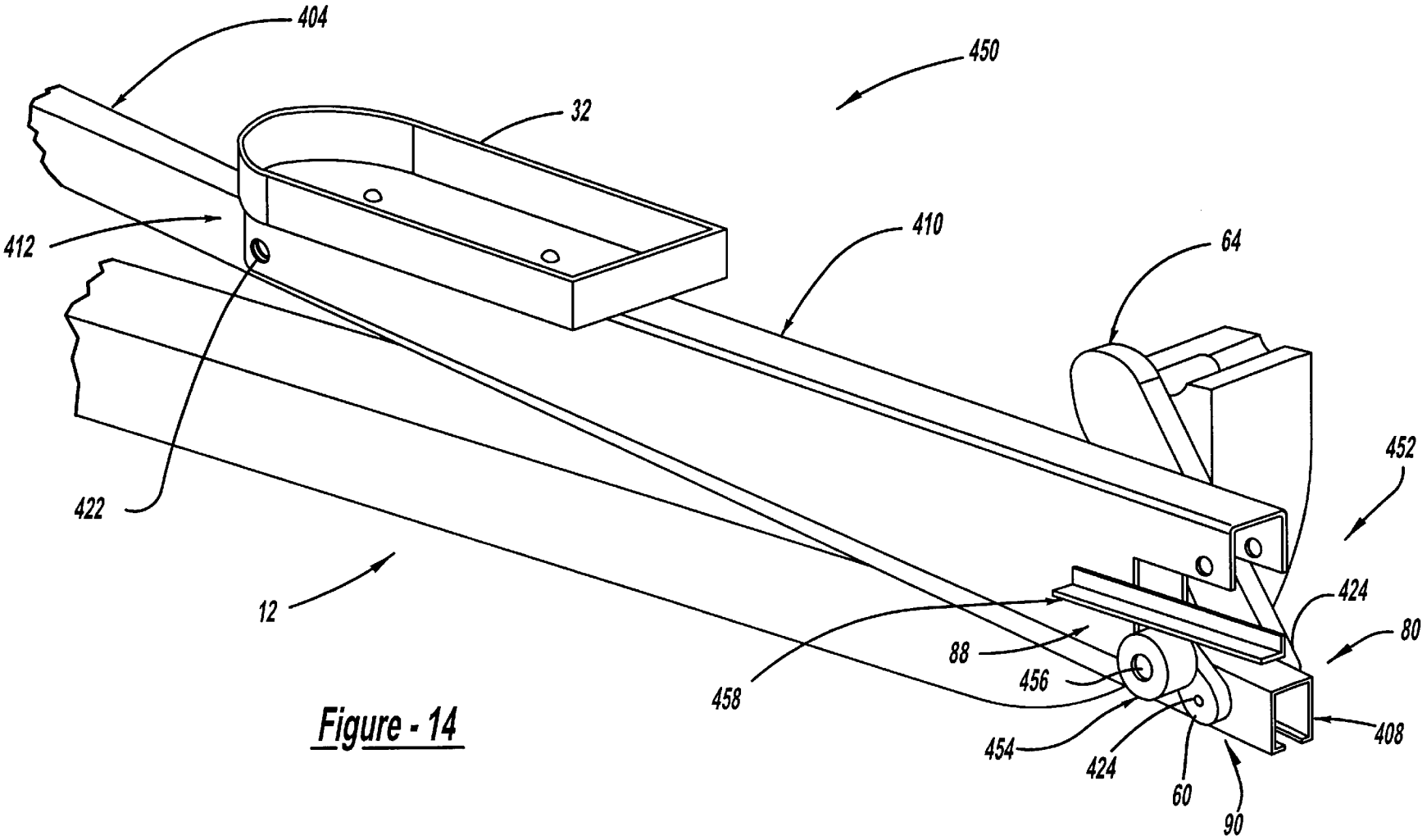
FIG. 14 is a partial simplified side perspective view of a seventh embodiment of an exercise apparatus according to the invention.

FIG. 14 shows a seventh general embodiment of an exercise apparatus 450 according to the invention. As noted previously, the exercise apparatus 450 of the invention includes a seventh type of pedal actuation assembly and therefore implements the desired elliptical pedal motion in a similar fashion as the exercise apparatuses 10, 200, 250, 300, 350 and 400. As with the previous exercise apparatuses 10, 200, 250, 300, 350 and 400, the exercise apparatus 450 includes, but is not limited to, the frame 12, the rocker 30, the pedal 32, the pulley 38 and associated pivot axle 40, and the various motion controlling components, such as the alternator 42 and the transmission 44. The exercise apparatus 450 differs primarily from the exercise apparatus 400, along with the various embodiments described above, in the nature and construction of the pedal actuation assembly. As noted earlier, the pedal actuation assembly refers to those components which cooperate to (1) provide an elliptical path and (2) provide the desired foot flexure and weight distribution on the pedal 32.

A pedal actuation assembly 452 of the exercise apparatus 450 includes the pedal lever 404, the pedal mount link 410, the pedal 32, the crank 64 and the extension arm 60. The exercise apparatus 450 differs from the exercise apparatus 400 in that the pickle link 416 attached to the rearward end 414 of the pedal mount link 410 is replaced by a roller 454. As explained in more detail above, the forward end 412 of the pedal mount link 410 of the exercise apparatus 450 is pivotally connected to the pedal lever 404 at the pivot point 422. The forward end 80 of the crank 64 is pivotally connected to the rearward end 408 of the pedal lever 404 at the pivot point 424 while the rearward end 90 of the extension arm 60 is pivotally connected to the rearward end 408 of the pedal lever 404 at the pivot point 424. The roller 454 is pivotally connected to and rotates about the forward end 88 of the extension arm 60 on a shaft 456. Additionally, a track 458 is attached to the rearward end 414 of the pedal mount link 410 by any suitable attachment means. The roller 454 contacts and rolls along the track 458.

As the crank 64 rotates, the roller 454 and the extension arm 60 cause the pedal mount link 410 and the pedal lever 404 to articulate relative to one another. This provides a means for tuning the motion of the pedal 32. Thus, when the user operates the pedal 32 in the previously described manner, the pedal 32 moves along the elliptical pathway 104 in a manner that simulates a natural heel to toe flexure that minimizes or eliminates stresses due to unnatural foot flexures. Similarly, the exercise apparatus 450 thus provides a wide variety of exercise programs that can be tailored to the specific needs and desires of individual users, and consequently, enhances exercise efficiency and promotes a pleasurable exercise experience.

What is claimed is:

1. An exercise apparatus pedal mechanism comprising:

a frame;

a rotatable pivot axle supported by said frame;

a crank having a first end secured to said pivot axle for rotation therewith;

a non-circular cam secured to a second end of said crank for rotation therewith;

a pedal lever having a first end pivotally attached to said second end of said crank;

a pedal mount link including a pedal and having a first end pivotally secured to said pedal lever; and a cam follower rotatably secured to a second end of said pedal mount link and engaged with said cam such that said second end of said pedal link moves angularly with respect to said pedal lever as said crank rotates on said axle whereby said pedal travels in a generally elliptical pathway as said crank rotates on said axle.

2. The mechanism of claim 1 including a rocker member pivotally secured to said frame and wherein a second end of said pedal lever is pivotally connected to said rocker member.

3. The mechanism of claim 2 wherein said pedal mount link is configure in a general u-shape and is adapted to fit over a portion of said pedal lever.

4. The mechanism of claim 1 including a track secured to frame and including a roller rotatably secured to a second end of said pedal lever and engaged with said track.

5. An exercise apparatus pedal mechanism comprising:

a frame;

a rotatable pivot axle supported by said frame;

a crank having a first end secured to said pivot axle for rotation therewith;

a non-circular cam secured to a second end of said crank for rotation therewith;

a rocker member pivotally secured to said frame;

a pedal lever having a first end pivotally attached to said second end of said crank and a second end pivotally attached to said rocker member;

a pedal mount link including a pedal and having a first end pivotally secured to said pedal lever so as to move angularly with respect to said pedal lever; and a cam follower rotatably secured to a second end of said pedal mount link and engaged with said cam so as to cause said second end of said pedal link to move upwardly and downwardly with respect to said first end of said pedal lever as said crank rotates on said axle whereby said pedal travels in a generally elliptical pathway as said crank rotates on said axle.

* * * * *